US009834357B2

(12) United States Patent
Kawata

(10) Patent No.: US 9,834,357 B2
(45) Date of Patent: Dec. 5, 2017

(54) PACKING DEVICE

(71) Applicant: Oki Data Corporation, Tokyo (JP)

(72) Inventor: Mitsuhiro Kawata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 144 days.

(21) Appl. No.: 14/242,132

(22) Filed: Apr. 1, 2014

(65) Prior Publication Data

US 2014/0305838 A1 Oct. 16, 2014

(30) Foreign Application Priority Data

Apr. 12, 2013 (JP) ..... 2013-083793

(51) Int. Cl.

| | |
|---|---|
| ***B65D 75/00*** | (2006.01) |
| ***B65D 77/04*** | (2006.01) |
| ***B65D 5/50*** | (2006.01) |
| ***G03G 21/18*** | (2006.01) |

(52) U.S. Cl.

CPC ..... *B65D 77/0433* (2013.01); *B65D 5/5035* (2013.01); *B65D 5/5073* (2013.01); *G03G 21/181* (2013.01); *G03G 2215/0141* (2013.01); *G03G 2221/1807* (2013.01)

(58) Field of Classification Search

USPC ..... 206/576, 320, 701, 722, 723, 724

See application file for complete search history.

(56) References Cited

U.S. PATENT DOCUMENTS

| | | | | |
|---|---|---|---|---|
| 3,718,275 | A * | 2/1973 | Willinger | B65D 5/5035 206/499 |
| 4,972,954 | A * | 11/1990 | Dickie | B65D 5/509 206/523 |
| 5,307,117 | A * | 4/1994 | Harlan | G03G 21/181 206/389 |
| 5,533,620 | A * | 7/1996 | Torterolo | B65D 85/672 206/396 |
| 6,685,025 | B1 * | 2/2004 | Kari | B65D 5/5052 206/583 |
| 6,968,947 | B2 * | 11/2005 | Johnson | B65B 9/073 206/423 |
| 7,278,249 | B2 * | 10/2007 | Kari | B65D 5/5069 206/485 |

(Continued)

FOREIGN PATENT DOCUMENTS

| | | |
|---|---|---|
| JP | S60-75287 U | 5/1985 |
| JP | H05-42125 U | 6/1993 |
| JP | H11-301741 A | 11/1999 |

*Primary Examiner* — Jacob K Ackun

(74) *Attorney, Agent, or Firm* — Metrolexis Law Group PLLC

(57) ABSTRACT

A packing device includes: a packing box with an internal space capable of storing a packing target object with a protection target part, and with a packing box inner surface that is at least one inner surface positioned to face the protection target part of the packing target object; and a holding material configured to, when stored in the internal space together with the packing target object, maintain a space between the protection target part and the packing box inner surface by coming into contact with the packing box inner surface and a contact surface of the packing target object facing the packing box inner surface, while staying out of contact with the protection target part of the packing target object.

16 Claims, 32 Drawing Sheets

(56) References Cited

U.S. PATENT DOCUMENTS

| | | | | |
|---|---|---|---|---|
| 7,458,465 | B1 * | 12/2008 | Dahl | B65D 81/107 206/521 |
| 7,636,529 | B2 * | 12/2009 | Kamimura | B65D 81/113 206/320 |
| 7,703,608 | B2 * | 4/2010 | Hsu | B41J 2/1752 206/320 |
| 8,919,564 | B2 * | 12/2014 | Noguchi | B65D 5/42 206/594 |
| 2003/0062286 | A1 * | 4/2003 | Igarashi | B65D 81/052 206/522 |
| 2003/0080023 | A1 * | 5/2003 | Slot | B65D 81/133 206/588 |
| 2003/0209464 | A1 * | 11/2003 | Otsuka | B65D 81/113 206/586 |
| 2004/0084349 | A1 * | 5/2004 | Kari | B65D 5/5069 206/583 |
| 2006/0131207 | A1 * | 6/2006 | Kari | B65D 5/5045 206/591 |
| 2009/0188833 | A1 * | 7/2009 | Klos | B65D 81/07 206/583 |
| 2012/0085678 | A1 * | 4/2012 | Yoshida | B65D 5/5035 206/592 |
| 2013/0008812 | A1 * | 1/2013 | Swart | B65D 5/0281 206/320 |

* cited by examiner

PACKING DEVICE

CROSS REFERENCE TO RELATED APPLICATIONS

This application claims priority based on 35 USC 119 from prior Japanese Patent Application No. 2013-083793 filed on Apr. 12, 2013, entitled "PACKING DEVICE", the entire contents of which are incorporated herein by reference.

BACKGROUND OF THE INVENTION

1. Field of the Invention

This disclosure relates to a packing device suitable for application to protect a toner cartridge stored in a cardboard box from external impact during storage and transportation of the toner cartridge, for example.

2. Description of Related Art

There has heretofore been proposed a technique to store a toner cartridge, as a packing target object (content), in a packing box with cushioning materials fitted at both ends of the toner cartridge in a longitudinal direction, thereby reducing the impact applied on the toner cartridge when the packing box is dropped (see, for example, Patent Document 1: Japanese Patent Application Publication No. Hei 11-301741).

SUMMARY OF THE INVENTION

However, the conventional technique may fail to sufficiently hold the packing target object.

It is an objective of an embodiment of the invention to improve content-holding performance.

One aspect of the invention is a packing device that includes: a packing box with an internal space capable of storing a packing target object with a protection target part, and with a packing box inner surface that is at least one inner surface positioned to face the protection target part of the packing target object; and a holding material that, when stored in the internal space together with the packing target object, is configured to maintain a space between the protection target part and the packing box inner surface by coming into contact with the packing box inner surface and a contact surface of the packing target object facing the packing box inner surface, while keeping out of contact with the protection target part of the packing target object.

According to the above aspect, the content-holding performance is improved.

DETAILED DESCRIPTION OF EMBODIMENTS

Figure 1:
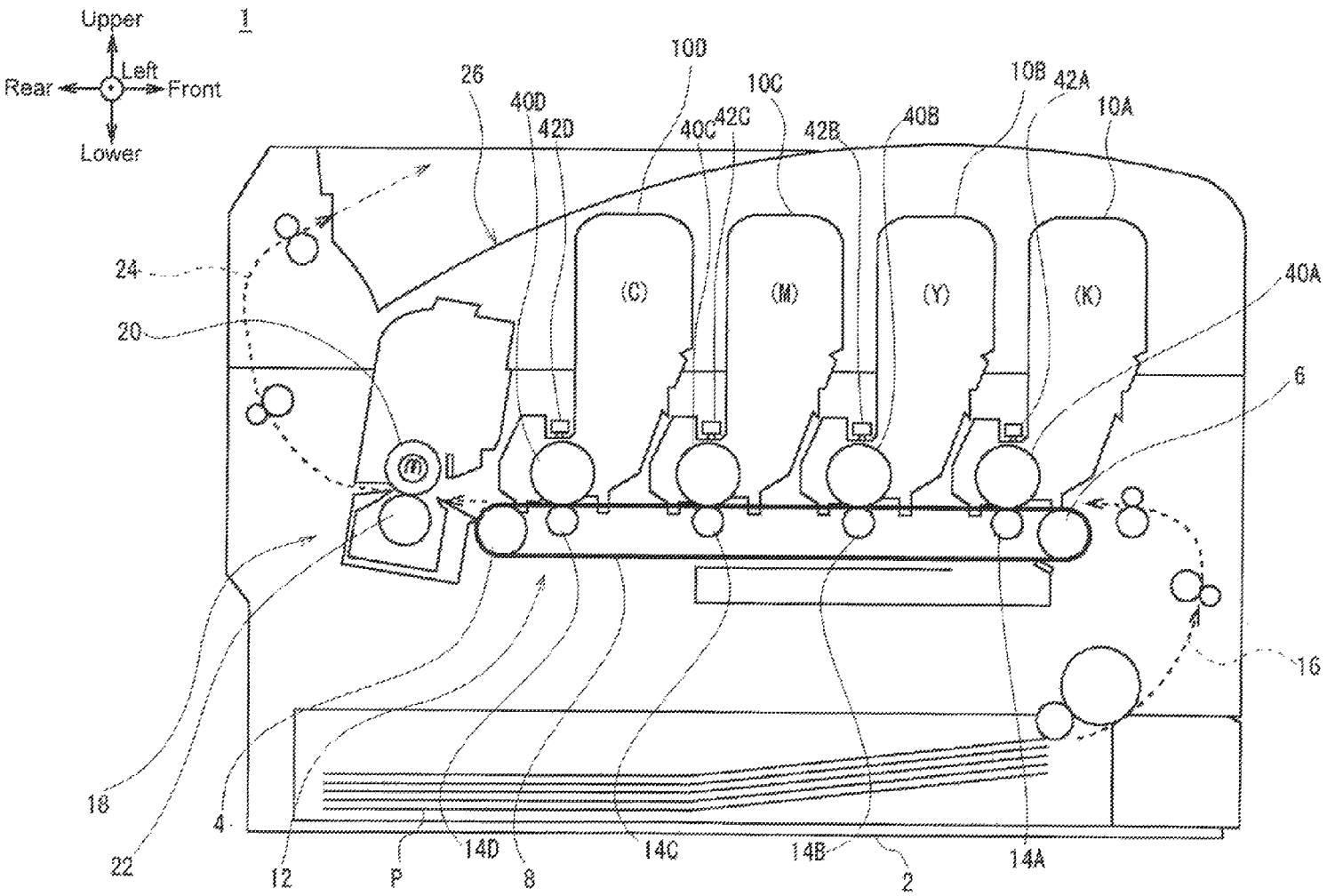
FIG. 1 is a cross-sectional view illustrating an internal configuration of a color printer according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

With reference to the drawings, embodiments of the invention are described below.

1. First Embodiment

[1-1. Internal Configuration of a Color Printer]

As illustrated in FIG. 1, color printer 1 has an approximately box-shaped printer housing 2. In the following description of color printer 1 and image formation unit 10, one of the sides of color printer 1 where a user faces the front of printer housing 2 is the front side. The opposite side thereto is the rear side, and left and right in relation to the user facing the front side are the left and right sides, respectively. Furthermore, the top and bottom are accordingly defined.

Printer housing 2 includes four image formation units 10 (10A to 10D) configured to form toner images by using toners to develop electrostatic latent images representing different color components of a print image.

In this case, four image formation units 10A to 10D have the same configuration except that toners of different colors are used to develop the electrostatic latent images. The image formation units are detachably mounted in order from front to rear in an upper end portion inside printer housing 2.

Image formation units 10A to 10D carry the electrostatic latent images, respectively. Also, photosensitive drums 40A to 40D are configured to carry toner images obtained by developing the electrostatic latent images with the toners and are rotatably provided in the image formation units.

Moreover, in image formation units 10A to 10D, LED (Light Emitting Diode) heads 42A to 42D are provided. LED heads 42A to 42D form electrostatic latent images on surfaces of photosensitive drums 40A to 40D by exposing the surfaces thereof.

With this configuration, image formation units 10A to 10D form electrostatic latent images representing predetermined color components by exposing the surfaces of photosensitive drums 40A to 40D with LED heads 42A to 42D while rotating photosensitive drums 40A to 40D during formation of the print image. Also, image formation units 10A to 10D form toner images by developing the electrostatic latent images with the toners.

Moreover, in the center of printer housing 2, transfer unit 12 is disposed below image formation units 10A to 10D. Transfer unit 12 transfers the toner images formed by image formation units 10A to 10D onto a surface of recording paper P.

Transfer unit 12 includes drive roller 4 and tension roller 6. Drive roller 4 is rotatably provided obliquely behind and below image formation unit 10D. Tension roller 6 is rotatably provided below image formation unit 10A.

Transfer unit 12 also includes transfer belt 8 stretched over drive roller 4 and tension roller 6. Transfer belt 8 conveys recording paper P by electrostatic adsorption for transfer of the toner images.

In addition, inside transfer belt 8 in transfer unit 12, four transfer rollers 14A to 14D corresponding to four photosensitive drums 40A to 40D are rotatably provided in order from front to rear.

With this configuration, transfer unit 12 transfers the toner images on the surfaces of four photosensitive drums 40A to 40D onto the surface of recording paper P. This transfer is performed by application of a direct-current voltage to transfer rollers 14A to 14D by sequentially tucking recording paper P, conveyed by transfer belt 8, through feed path 16 between upper side portions of the surfaces of transfer rollers 14A to 14D and lower side portions of the surfaces of four photosensitive drums 40A to 40D corresponding thereto, during formation of the print image.

In this way, transfer unit 12 transfers toner images of four colors onto the surface of recording paper P. Then, transfer unit 12 hands over recording paper P having the toner images transferred thereon to fixing unit 18.

In printer housing 2, fixing unit 18 configured to fix the toner images on the surface of recording paper P is disposed behind transfer unit 12.

Fixing unit 18 has a recording paper passage formed in the center for recording paper P to pass therethrough. Above and below the recording paper passage, heating roller 20 and pressure roller 22 are rotatably provided.

With this configuration, during formation of the print image, fixing unit 18 takes recording paper P, having the toner images transferred thereon, into the recording paper passage from transfer unit 12 and tucks recording paper P between heating roller 20 and pressure roller 22, which are rotated in opposite directions to each other.

Accordingly, fixing unit 18 fixes the toner images on the surface of recording paper P by heating and pressurizing recording paper P between heating roller 20 and pressure roller 22, which are rotated in opposite directions to each other. Thereafter, fixing unit 18 hands over recording paper P to discharge path 24 positioned on the downstream side in the conveyance direction.

In this way, fixing unit 18 fixes the toner images of four colors on the surface of recording paper P to form the print image, and then conveys recording paper P having the print image formed thereon through discharge path 24 and discharges recording paper P to recording paper delivery unit 26.

[1-2. Configuration of Image Formation Unit]

Image formation units 10A to 10D have the same configuration except for the difference in colors of the toners used to develop the electrostatic latent images. Therefore, in the following description, image formation units 10A to 10D are collectively referred to as image formation unit 10.

Figure 2:
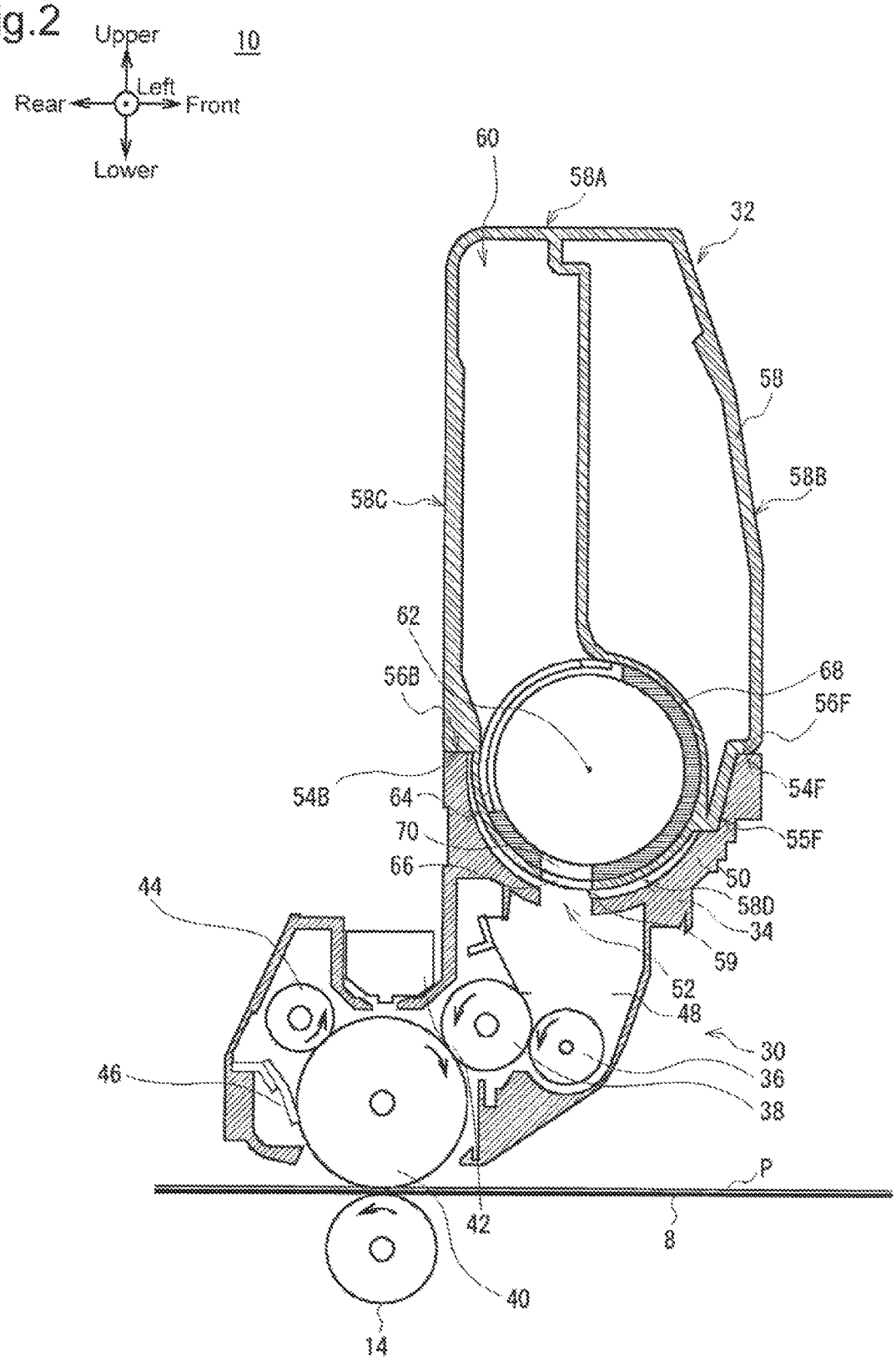
FIG. 2 is a cross-sectional view illustrating a configuration of an image formation unit.

As illustrated in FIG. 2, image formation unit 10 includes developing device 30 and toner cartridge 32.

Developing device 30 has an approximately J-shaped main body case 34, in which feed roller 36, developing roller 38, photosensitive drum 40, LED head 42, charging roller 44 and cleaning unit 46 are provided.

Feed roller 36 feeds a toner in toner storage chamber 48 toward developing roller 38. Developing roller 38 charges the toner to electrostatically adhere to the electrostatic latent image formed on photosensitive drum 40, thereby forming a toner image having a certain thickness. Charging roller 44 uniformly charges the surface of photosensitive drum 40. LED head 42 exposes the charged surface of photosensitive drum 40 based on print data to form an electrostatic latent image. Cleaning unit 46 removes the toner remaining on the surface of photosensitive drum 40 after the transfer.

Attachment part 50 is formed above developing device 30. Toner cartridge 32 is mounted on attachment part 50. Toner supply port 52 is provided in attachment part 50. The toner is supplied from toner cartridge 32 into toner storage chamber 48 through toner supply port 52.

On the front and rear sides of an upper end face of developing device 30, developing device contact surface 56 (developing device front contact surface 56F and developing device back contact surface 56B) is provided so as to extend along a horizontal direction. Developing device contact surface 56 is a flat surface which comes into contact with cartridge contact surface 54 (cartridge front contact surface 54F and cartridge back contact surface 54B) to be described later, which is formed in toner cartridge 32.

Toner cartridge 32 includes outer cartridge 58 made of resin and formed in an approximately thin rectangular parallelepiped shape. In an upper part of the inside of outer cartridge 58, toner container 60 configured to contain the toner therein is provided.

Outer cartridge 58 has planar container-side surface 58A, slightly curved planar cartridge front surface 58B, planar cartridge rear surface 58C and partial arc-shaped supply port-side surface 58D on the upper, front, rear and lower sides thereof.

Hereinafter, the direction of toner cartridge 32 along the horizontal direction is also referred to as a cartridge width direction, the direction of toner cartridge 32 along the vertical direction is also referred to as a cartridge height direction, and the direction approximately perpendicular to cartridge front surface 58B and cartridge rear surface 58C along the longitudinal direction is also referred to as a cartridge depth direction.

Outer cartridge 58 has its lower end portion formed into convex part 64. Convex part 64 is shorter than toner container 60 in the longitudinal direction and protrudes in an arc shape when viewed from the side with convex part central axis 62 as the center. Also, slit-like toner supply port 66 is provided in outer cartridge 58. Toner supply port 66 connects to toner container 60 and extends parallel to the cartridge width direction from supply port-side end 59 that is a tip of convex part 64 toward the back.

Inside convex part 64, stir bar (not illustrated), which is long in the cartridge width direction, is provided so as to be rotatable about an axis parallel to the cartridge width direction.

Since convex part 64 is formed in the arc shape, toner cartridge 32 can supply the toner in convex part 64 to developing device 30 from toner supply port 66 by using the stir bar while leaving almost no toner in convex part 64.

On the front and rear sides of convex part 64, cartridge front contact surface 54F as a first contact surface and cartridge back contact surface 54B as a second contact surface (hereinafter also collectively referred to as cartridge contact surface 54), both of which are planar steps, are provided so as to extend along the horizontal direction between convex part 64 and toner container 60. Cartridge contact surface 54 comes into contact with developing device contact surface 56.

Cartridge front contact surface 54F and cartridge back contact surface 54B are formed at the same distance from container-side surface 58A along the vertical direction (cartridge height direction).

Moreover, from a rear end of cartridge front contact surface 54F, cartridge front locking part 55F is provided upright toward supply port-side end 59. Cartridge front locking part 55F comes into contact with an inner wall surface of attachment part 50 of developing device 30.

With this configuration, toner cartridge 32 is positioned relative to developing device 30 when fitted into developing device 30, and is fixed by an unillustrated fixing mechanism.

In outer cartridge 58, shutter 68 is configured to open and close toner supply port 66 and is provided inside convex part 64. Shutter 68 is formed to have an arc surface centered at convex part central axis 62 along the arc shape of convex part 64, and has opening 70. Operation lever 72 illustrated in FIGS. 3 and 4 is connected to shutter 68 and is turned in response to an operation by operation lever 72.

Figure 3:
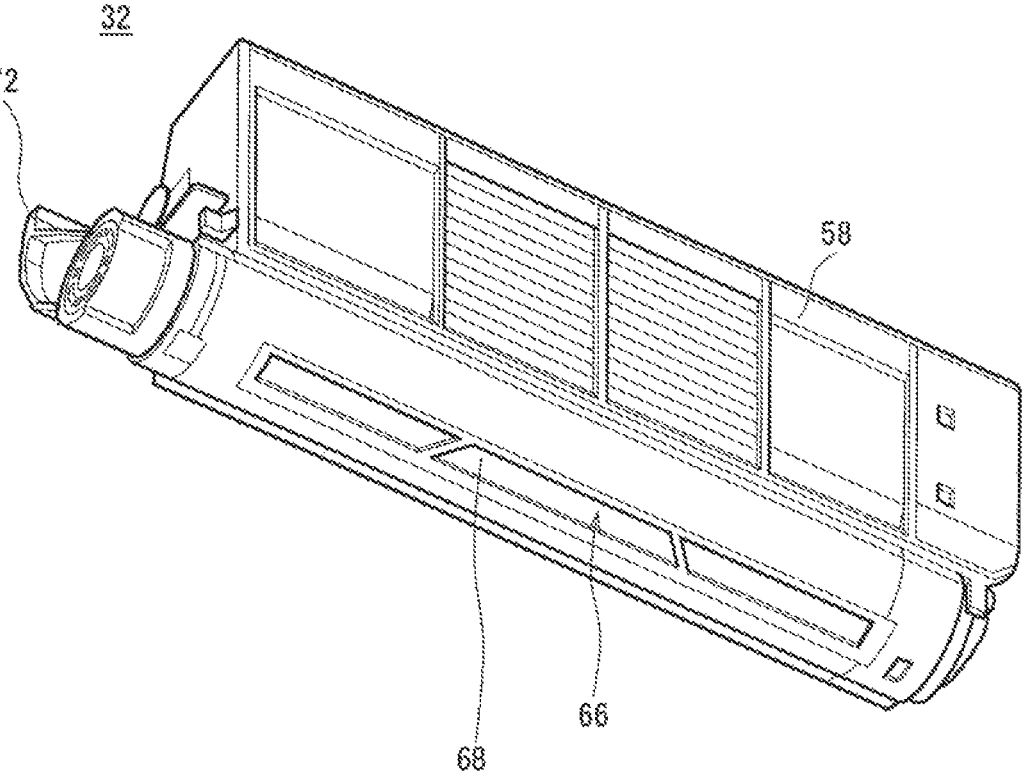
FIG. 3 is a perspective view illustrating a configuration (1) of a toner cartridge.
Figure 4:
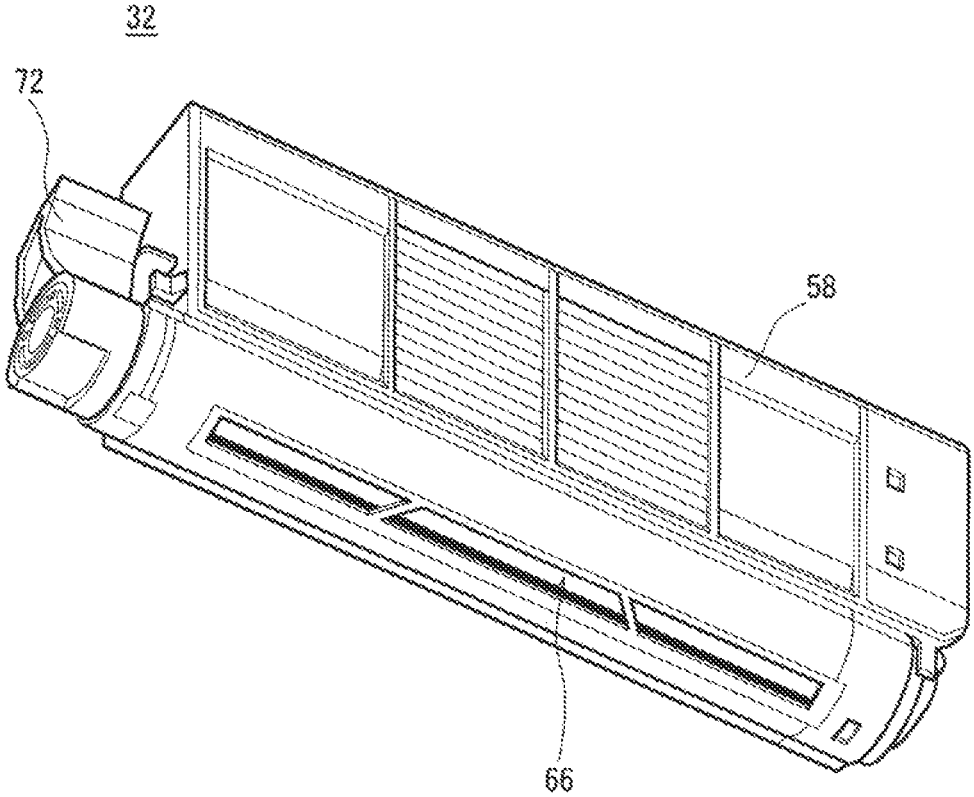
FIG. 4 is a perspective view illustrating a configuration (2) of a toner cartridge.

More specifically, in the state of operation lever 72 illustrated in FIG. 3, shutter 68 closes toner supply port 66. When operation lever 72 is operated as illustrated in FIG. 4 from this state, shutter 68 is turned and opening 70 coincides with toner supply port 66. Thus, toner supply port 66 is opened. Accordingly, the toner is supplied to developing device 30 from toner cartridge 32.

In the above configuration, image formation unit 10 supplies the toner into toner storage chamber 48 in developing device 30 from toner container 60 through opening 70 of shutter 68 in convex part 64, toner supply port 66 and toner supply port 52.

Then, image formation unit 10 uses LED head 42 to expose the surface of photosensitive drum 40, which is uniformly charged by charging roller 44, based on print data, thereby forming an electrostatic latent image.

Thereafter, image formation unit 10 uses developing roller 38 to make the toner electrostatically adhere to the electrostatic latent image formed on photosensitive drum 40, with the toner being supplied from toner storage chamber 48 by feed roller 36. Thus, image formation unit 10 forms a toner image.

Furthermore, image formation unit 10 tucks recording paper P conveyed by transfer belt 8 between transfer roller 14 and photosensitive drum 40, and transfers the toner image on the surface of photosensitive drum 40 onto the surface of recording paper P.

[1-3. Configuration of Package]

Figure 5:
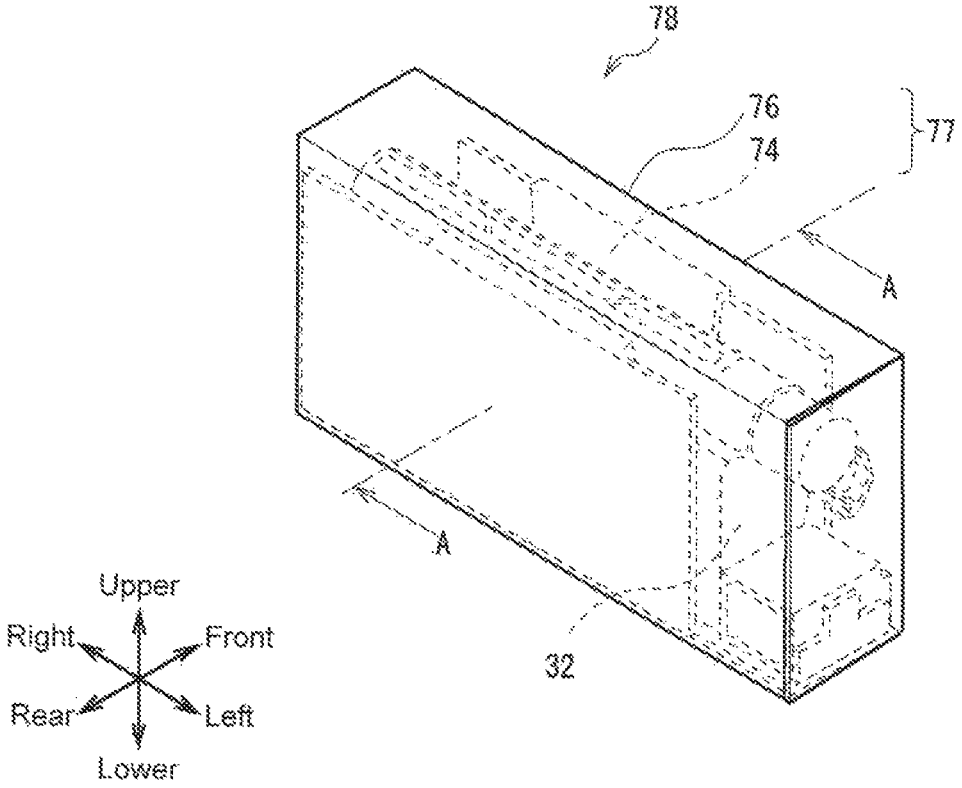
FIG. 5 is a perspective view illustrating a configuration of a package according to the first embodiment.

As illustrated in FIG. 5, toner cartridge 32 is stored and transported while being stored in packing box 76 in a state of being packed with cushioning material 74 as a holding material. Cushioning material 74 absorbs vibration and shock during transportation and protects toner cartridge 32 from breakage. Hereinafter, toner cartridge 32 packed with cushioning material 74 and stored in packing box 76 is referred to as package 78. Cushioning material 74 and packing box 76 are collectively referred to as packing device 77 or packing device 77.

In the following description, the direction in which cartridge front surface 58B (FIG. 2) faces in storage body 78 is the front side. The direction in which cartridge rear surface 58C faces is the back side. The protruding direction of operation lever 72 is the left side, the opposite side thereto is the right side, the direction in which supply port-side surface 58D faces is the top side, and the direction in which container-side surface 58A faces is the bottom side.

[1-4. Configuration of Packing Box]

Figure 6:
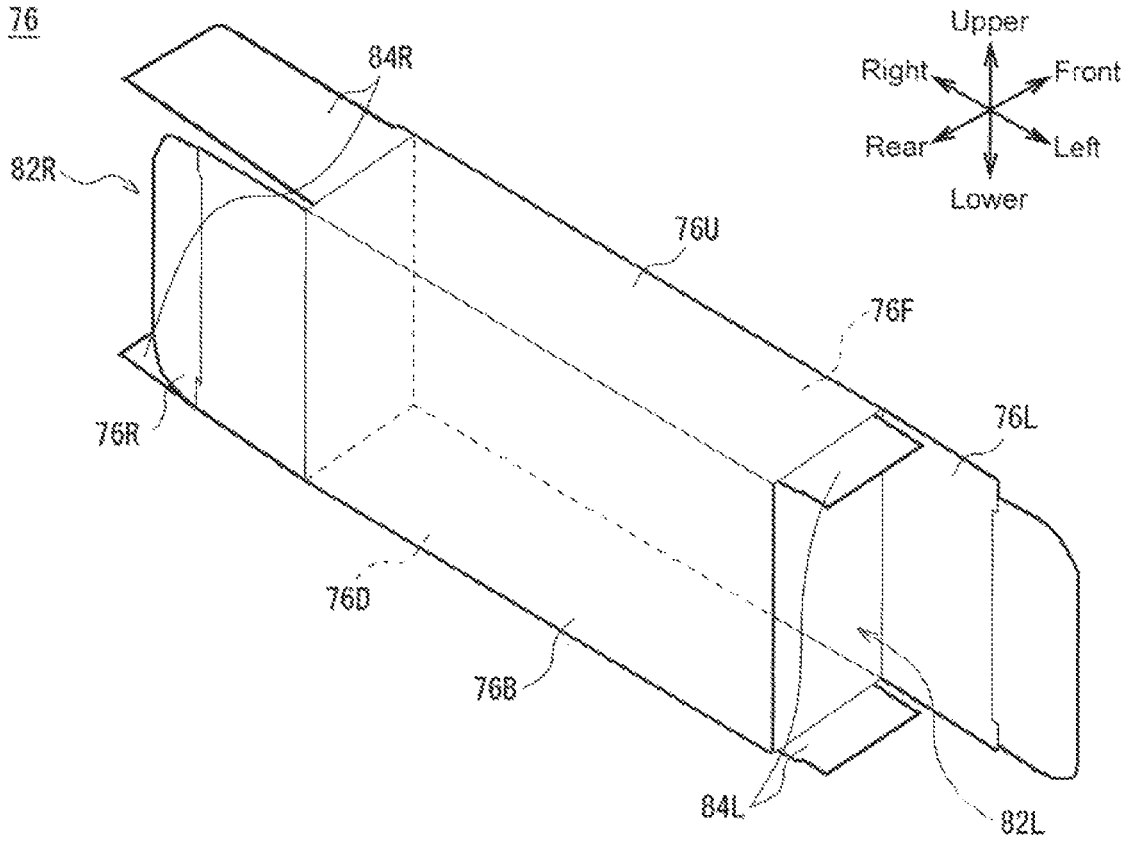
FIG. 6 is a perspective view illustrating a configuration of a packing box.
Figure 8B:
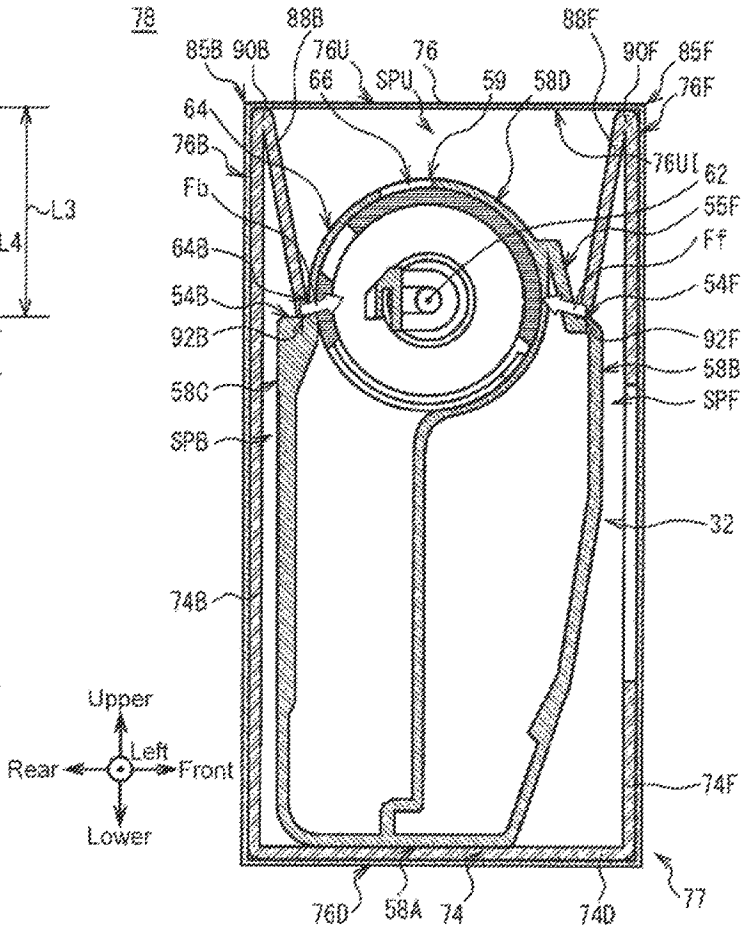
FIG. 8A is a left side view and FIG. 8B is a cross-sectional view taken along the line indicated by the arrows A-A in FIG. 5, illustrating the configuration of the package according to the first embodiment.
Figure 8A:
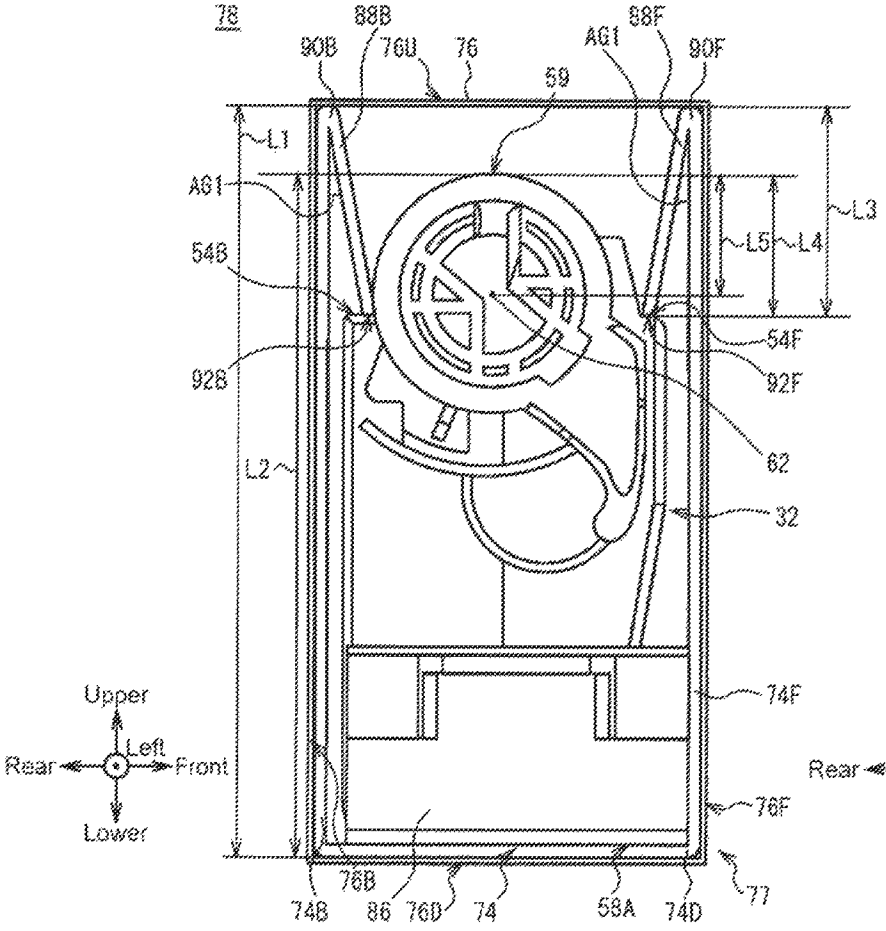

Packing box 76 is made of cardboard and has a rectangular parallelepiped box shape with an internal space formed inside. Packing box 76 has plate-like box top panel 76U, box bottom panel 76D, box front panel 76F, box back panel 76B, left-side lid 76L and right-side lid 76R on the top, bottom, front, back, left and right sides as illustrated in FIGS. 6 and 8. Packing box 76 stores toner cartridge 32 packed with cushioning material inside. Hereinafter, toner cartridge 32 packed with cushioning material 74 is also referred to as toner cartridge 80 with cushioning material.

As illustrated in FIG. 6, right-side opening 82R and left-side opening 82L are formed on the right and left sides of packing box 76. At right-side opening 82R, right-side folding panels 84R project rightward from the top and bottom sides and right-side lid 76R projects rightward from the back side. Meanwhile, at left-side opening 82L, left-side folding panels 84L are formed shorter than right-side folding panels 84R and project leftward from the top and bottom sides. Left-side lid 76L projects leftward from the front side.

Figure 7:
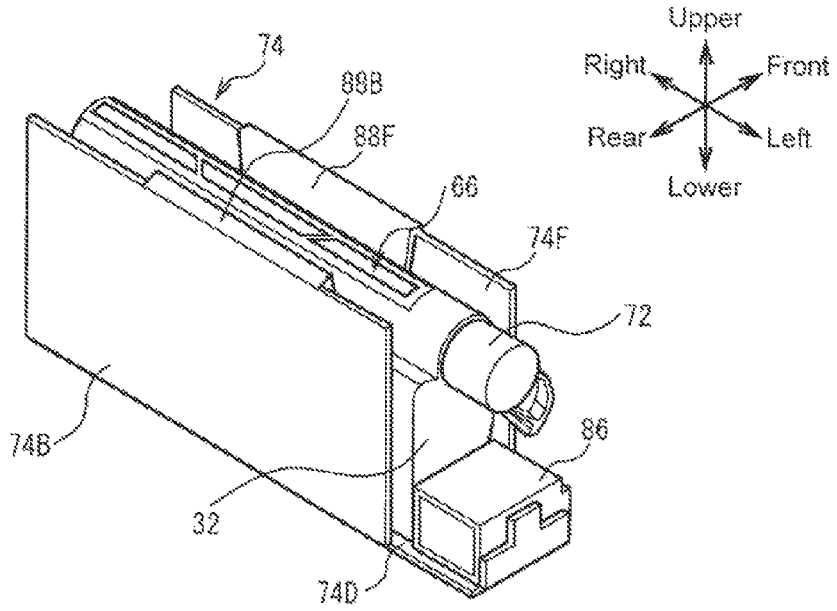
FIG. 7 is a perspective view illustrating a configuration of a toner cartridge with a cushioning material according to the first embodiment.

After toner cartridge 80 with cushioning material illustrated in FIG. 7 is placed inside this packing box 76, right-side opening 82R is closed by folding right-side folding panels 84R and then tucking down right-side lid 76R, and left-side opening 82L is closed by folding left-side folding panels 84L and then tucking down left-side lid 76L. Thus, packing box 76 restricts movement of toner cartridge 80 with cushioning material in vertical, horizontal and front-back directions.

Toner cartridge 32 is stored inside packing box 76 such that toner supply port 66 faces box top panel 76U by facing upward and operation lever 72 faces left-side lid 76L.

As illustrated in FIG. 8, front-side space SPF is formed between cartridge front surface 58B as a first side surface that is a front surface of toner cartridge 32 and box front panel 76F as a first packing box panel of packing box 76. Also, back-side space SPB is formed between cartridge back surface 58C as a second side surface that is a back surface of toner cartridge 32 and box back panel 76B as a second packing box panel of packing box 76.

Since left-side folding panels 84L are formed shorter than right-side folding panels 84R, left-side folding panels 84L do not overlap with each other even when left-side folding panels 84L are folded. Thus, the user can easily put his/her fingers into packing box 76 from between tips of top and bottom left-side folding panels 84L just by opening left-side lid 76L, and can pull out toner cartridge 32 by grabbing operation lever 72 of toner cartridge 32 or the like.

[1-5. Configuration of Cushioning Material]

Cushioning material 74 is made of cardboard, for example, and has cushioning material bottom panel 74D, cushioning material front panel 74F, cushioning material back panel 74B, tube part 86, front-side tucking panel 88F and back-side tucking panel 88B.

Cushioning material bottom panel 74D is formed slightly shorter than box bottom panel 76D of packing box 76 in left-right and front-back directions. A lower surface of cushioning material bottom panel 74D comes into contact with an upper surface of box bottom panel 76D, and an upper surface thereof comes into contact with container side surface 58A of toner cartridge 32.

On a left-side end of cushioning material bottom panel 74D, tube part 86 is formed, which has a rectangular parallelepiped box shape with openings in the front and back. Tube part 86 has a right-side surface coming into contact with the left-side surface of toner cartridge 32 and a left-side surface coming into contact with the right-side surface of left-side lid 76L of packing box 76.

Tube part 86 is formed slightly shorter than box bottom panel 76D of packing box 76 in the front-back direction, and is formed longer than operation lever 72 of toner cartridge 32 in the left-right direction.

With this configuration, tube part 86 can prevent any impact on operation lever 72 of toner cartridge 32 when operation lever 72 comes into contact with left-side lid 76L of packing box 76. Thus, tube part 86 can prevent a situation where the toner leaks from around a base of operation lever 72.

From front and back ends of cushioning material bottom panel 74D, cushioning material front panel 74F and cushioning material back panel 74B as plate-like first and second cushioning material panels are provided upright so as to be approximately perpendicular to cushioning material bottom panel 74D.

Cushioning material front panel 74F and cushioning material back panel 74B are formed shorter than box front panel 76F and box back panel 76B of packing box 76 in the left-right direction. Also, cushioning material front panel 74F and cushioning material back panel 74B are formed slightly shorter than box front panel 76F and box back panel 76B of packing box 76 in the top-bottom direction.

Cushioning material front panel 74F and cushioning material back panel 74B have their upper portions restricted from moving forward and backward by coming into contact with box front panel 76F and box back panel 76B of packing box 76.

Cushioning material front panel 74F serving as a first holding material panel and cushioning material back panel 74B serving as a second holding material panel are folded backward and forward, respectively, at front-side folding part 90F and back-side folding part 90B positioned at upper ends thereof. Thus, front-side tucking panel 88F as a first contact material and back-side tucking panel 88B as a second contact material are formed, respectively.

Front-side folding part 90F comes into contact with the inside of box upper front corner 85F as a first corner at which box top panel 76U serving as a third packing box panel and box front panel 76F of packing box 76 come into contact with each other. Meanwhile, backside folding part 90B comes into contact with the inside of box upper back corner 85B as a second corner at which box top panel 76U and box back panel 76B of packing box 76 come into contact with each other.

Front-side tucking panel 88F and back-side tucking panel 88B are formed to have a horizontal length of about ⅓ to ⅔ of that of toner cartridge 32 in the cartridge width direction, and to have a vertical length of approximately ⅓ of that of toner cartridge 32 in the cartridge height direction.

Front-side locking part 92F and back-side locking part 92B provided at respective lower ends of front-side tucking panel 88F and back-side tucking panel 88B are locked to cartridge front contact surface 54F and cartridge back contact surface 54B.

As described above, cushioning material 74 restricts upward movement of toner cartridge 32 by allowing the upper end of front-side tucking panel 88F to come into contact with box upper front corner 85F and the lower end thereof to come into contact with cartridge front contact surface 54F and by allowing the upper end of back-side tucking panel 88B to come into contact with box upper back corner 85B and the lower end thereof to come into contact with cartridge back contact surface 54B.

In this state, front-side tucking panel 88F and back-side tucking panel 88B have a folding angle AG1 of 20 degrees or less relative to cushioning material front panel 74F and cushioning material back panel 74B (i.e., box front panel 76F and box back panel 76B), respectively. In this embodiment, folding angle AG1 is set to 10 degrees.

Vertical length L1 from box bottom panel 76D to the upper ends of cushioning material front panel 74F and cushioning material back panel 74B (i.e., the height of cushioning material front panel 74F and cushioning material back panel 74B) is set longer than vertical length L2 from box bottom panel 76D to supply port side end 59 of toner cartridge 32 (i.e., the height of toner cartridge 32).

Also, vertical length L3 from box top panel 76U to front-side locking part 92F and back-side locking part 92B (i.e., the height of front-side tucking panel 88F and back-side tucking panel 88B) is set longer than vertical length L4 from supply port side end 59 to cartridge front contact surface 54F and cartridge back contact surface 54B.

For this reason, upper space SPU is formed between toner supply port 66 of toner cartridge 32 and box top panel inner surface 76 UI that is an inner surface of box top panel 76U of packing box 76.

With this configuration, cushioning material 74 prevents toner supply port 66 of toner cartridge 32 from coming into contact with box top panel 76U when package 78 is dropped.

Front-side tucking panel 88F and back-side tucking panel 88B are formed by folding cushioning material front panel 74F and cushioning material back panel 74B at front-side folding part 90F and back-side folding part 90B. For this reason, resilient forces Ff and Fb are generated, which return front-side tucking panel 88F and back-side tucking panel 88B to their original shape with front-side folding part 90F and back-side folding part 90B as supporting points.

For this reason, front-side tucking panel 88F comes into contact with toner cartridge 32 so as to be biased toward cartridge front-side locking part 55F provided upright from the rear end of cartridge front contact surface 54F of toner cartridge 32 while having front-side locking part 92F locked to cartridge front contact surface 54F.

Meanwhile, back-side tucking panel 88B comes into contact with toner cartridge 32 so as to be biased toward the rear side surface of convex part 64 provided upright from the front end of cartridge back contact surface 54B of toner cartridge 32 while having back-side locking part 92B locked to cartridge back contact surface 54B.

Moreover, vertical length L4 from supply port side end 59 to cartridge front contact surface 54F and cartridge back contact surface 54B is set longer than vertical length L5 from supply port side end 59 to convex part central axis 62.

More specifically, back-side locking part 92B of back-side tucking panel 88B comes into contact with a portion which is positioned below convex part back end 64B protruding most backward in the curved shape of convex part 64 of toner cartridge 32 and slightly in front of convex part back end 64B, and is curved so as to be tilted from back to front in the direction from top to bottom.

As described above, cushioning material 74 supports toner cartridge 32 without coming into direct contact with toner supply port 66, thereby fixing the position of toner cartridge 32 inside packing box 76 and maintaining upper space SPU.

[1-6. Packing Method]

Cushioning material 74 described above is built through the following steps to pack toner cartridge 32, and is stored in packing box 76.

Figure 9:
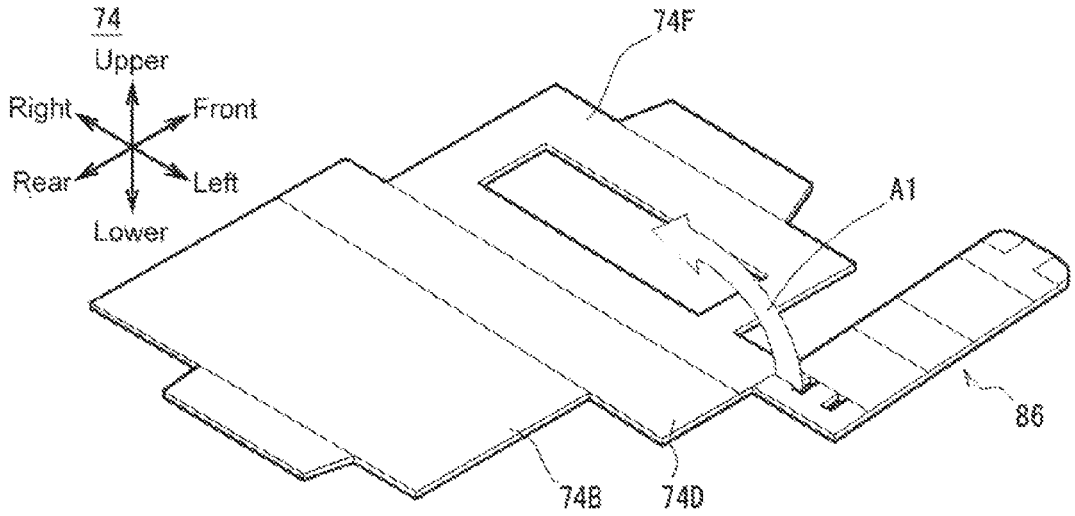
FIG. 9 is a perspective view illustrating a step (1) of packing according to the first embodiment.

FIG. 9 illustrates cushioning material 74 before being built up. Cushioning material 74 is formed by cutting a cardboard sheet into a predetermined sheet shape with folding lines and slits provided at predetermined positions.

Figure 10:
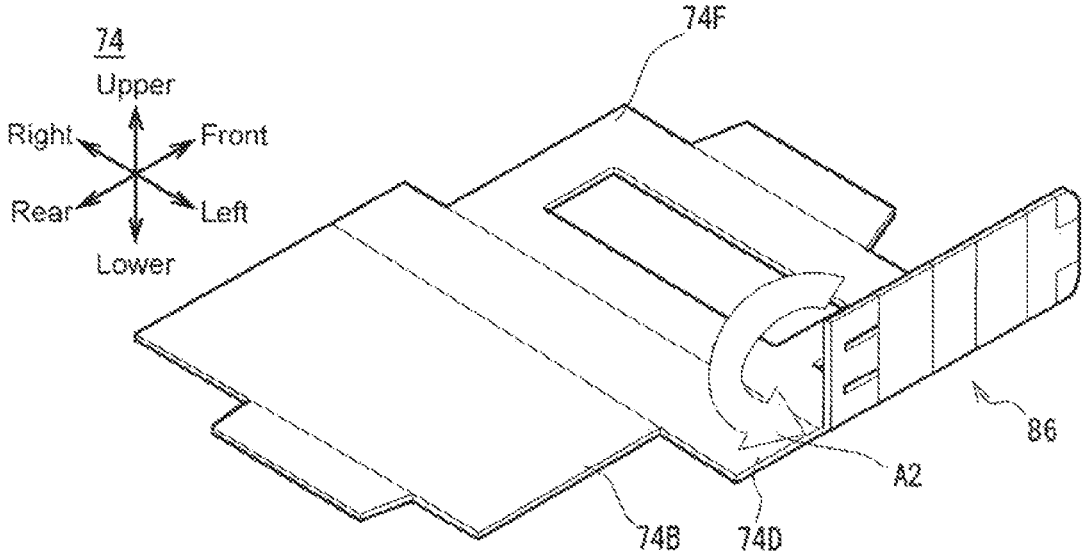
FIG. 10 is a perspective view illustrating a step (2) of packing according to the first embodiment.
Figure 11:
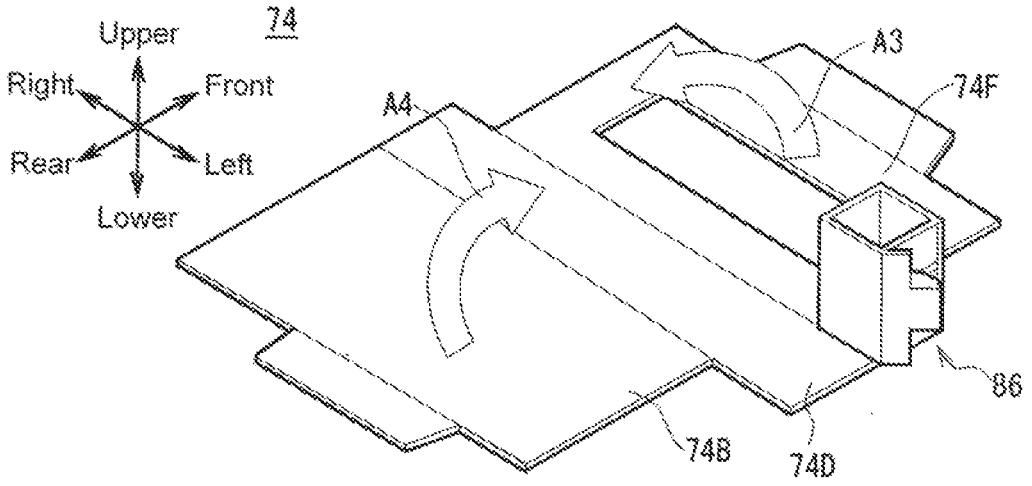
FIG. 11 is a perspective view illustrating a step (3) of packing according to the first embodiment.

A worker folds tube part 86 of cushioning material 74 illustrated in FIG. 9 inward toward cushioning material front panel 74F along arrow direction A1 to obtain a state illustrated in FIG. 10. Then, the worker further folds tube part 86 so as to be rolled up along arrow direction A2, thereby building tube part 86 as illustrated in FIG. 11.

Thereafter, the worker folds cushioning material front panel 74F inward toward cushioning material bottom panel 74D along arrow direction A3, and also folds cushioning material back panel 74B inward toward cushioning material bottom panel 74D along arrow direction A4. Accordingly, cushioning material front panel 74F and cushioning material back panel 74B are built upright so as to be approximately perpendicular to cushioning material bottom panel 74D as illustrated in FIG. 12.

Figure 12:
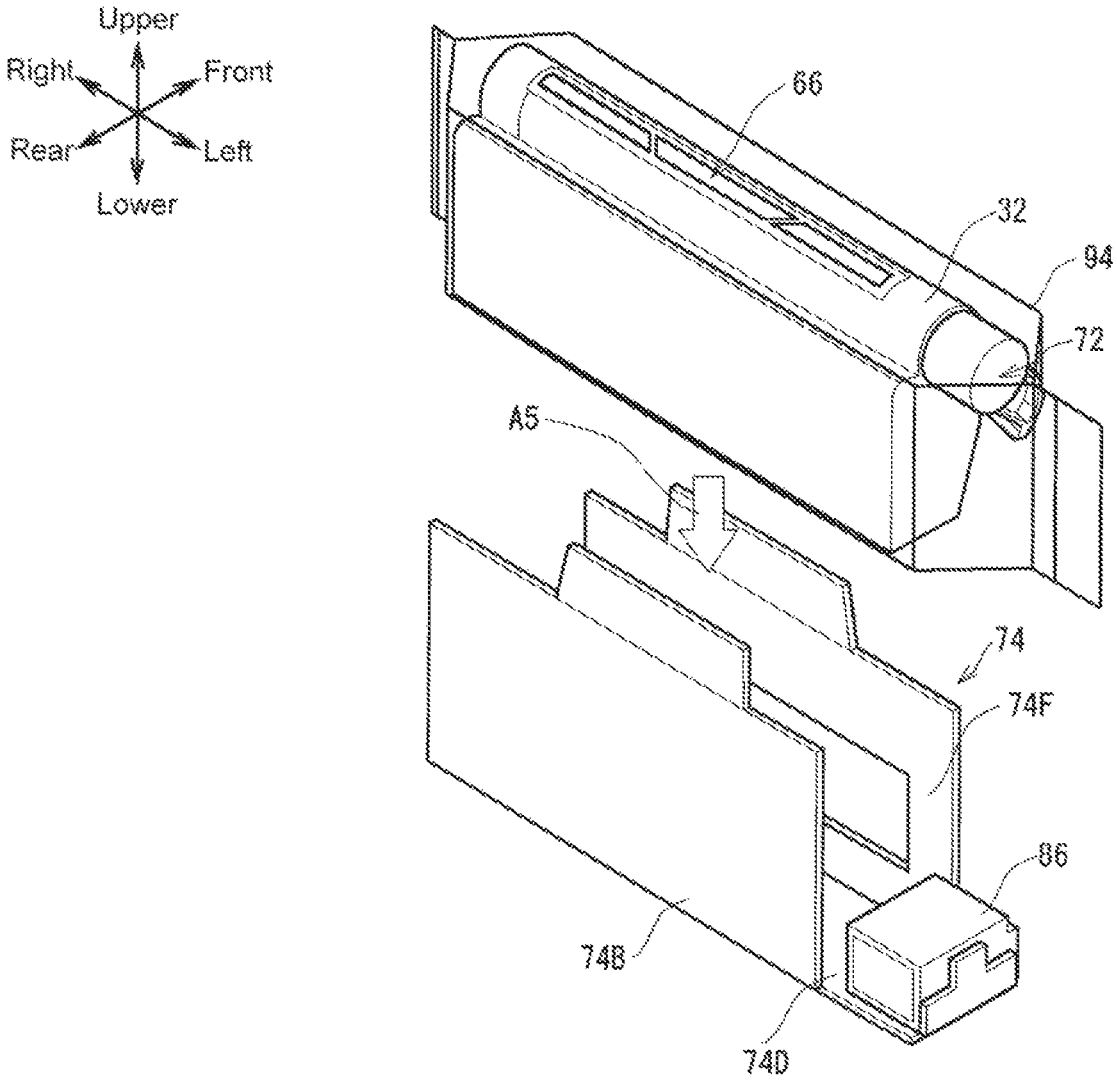
FIG. 12 is a perspective view illustrating a step (4) of packing according to the first embodiment.

Subsequently, as illustrated in FIG. 12, the worker places toner cartridge 32 packaged in moisture-proof bag 94 on cushioning material bottom panel 74D from between cushioning material front panel 74F and cushioning material back panel 74B along arrow direction A5 in a state where operation lever 72 is positioned above tube part 86 of cushioning material 74 with toner supply port 66 facing upward. Note that moisture-proof bag 94 is omitted in the drawings other than in FIG. 12.

Figure 13:
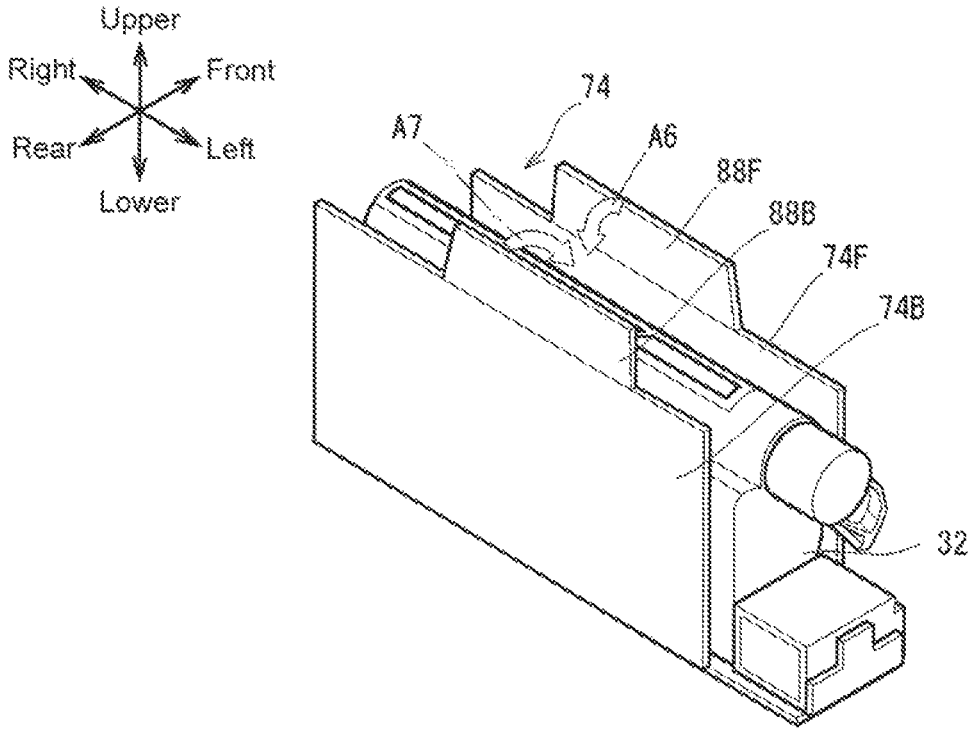
FIG. 13 is a perspective view illustrating a step (5) of packing according to the first embodiment.
Figure 14:
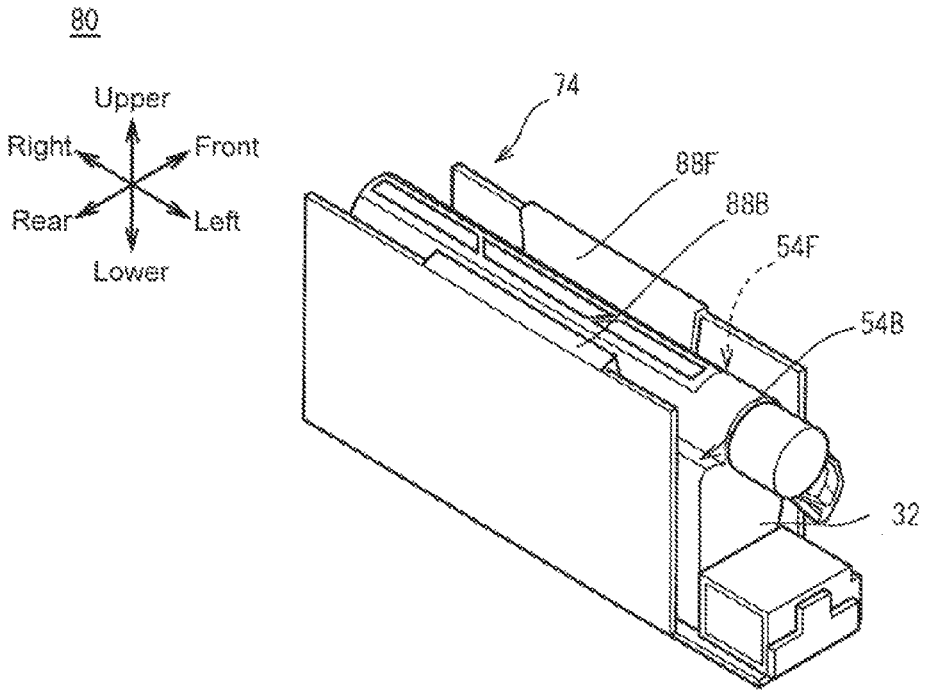
FIG. 14 is a perspective view illustrating a step (6) of packing according to the first embodiment.

Then, as illustrated in FIG. 13, the worker folds front-side tucking panel 88F inward toward toner cartridge 32 along arrow direction A6 and also folds back-side tucking panel 88B inward toward toner cartridge 32 along arrow direction A7. Thus, front-side tucking panel 88F and back-side tucking panel 88B are locked to cartridge front contact surface 54F and cartridge back contact surface 54B, respectively, as illustrated in FIG. 14. Accordingly, cushioning material 74 is built up to pack toner cartridge 32.

Figure 15:
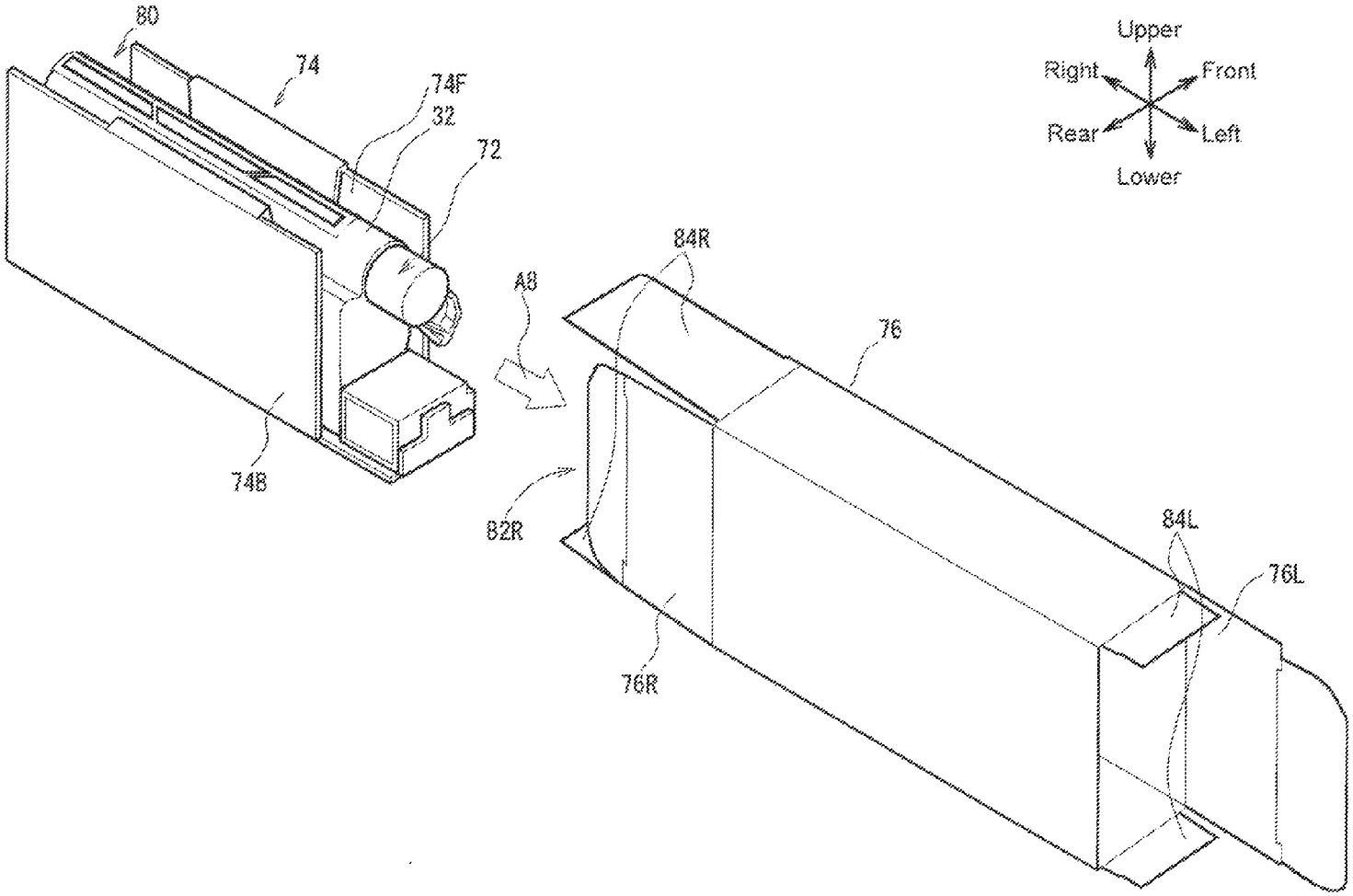
FIG. 15 is a perspective view illustrating a step (7) of packing according to the first embodiment.

Thereafter, the worker prevents cushioning material 74 from losing its shape by being pressed inward on cushioning material front panel 74F and cushioning material back panel 74B. Meanwhile, the worker puts toner cartridge 80 with cushioning material into packing box 76 through right-side opening 82R of packing box 76 from the operation lever 72 side along arrow direction A8 as illustrated in FIG. 15.

Subsequently, the worker engages cushioning material 74 with packing box 76 as illustrated in FIG. 5 by closing left-side lid 76L and right-side lid 76R after folding inward left-side folding panels 84L and right-side folding panels 84R of packing box 76.

Thus, cushioning material 74 is built so as to pack toner cartridge 32. Toner cartridge 80 with cushioning material is put inside packing box 76 and is thus set in a transportable state.

[1-7. Operations and Effects]

Figure 16:
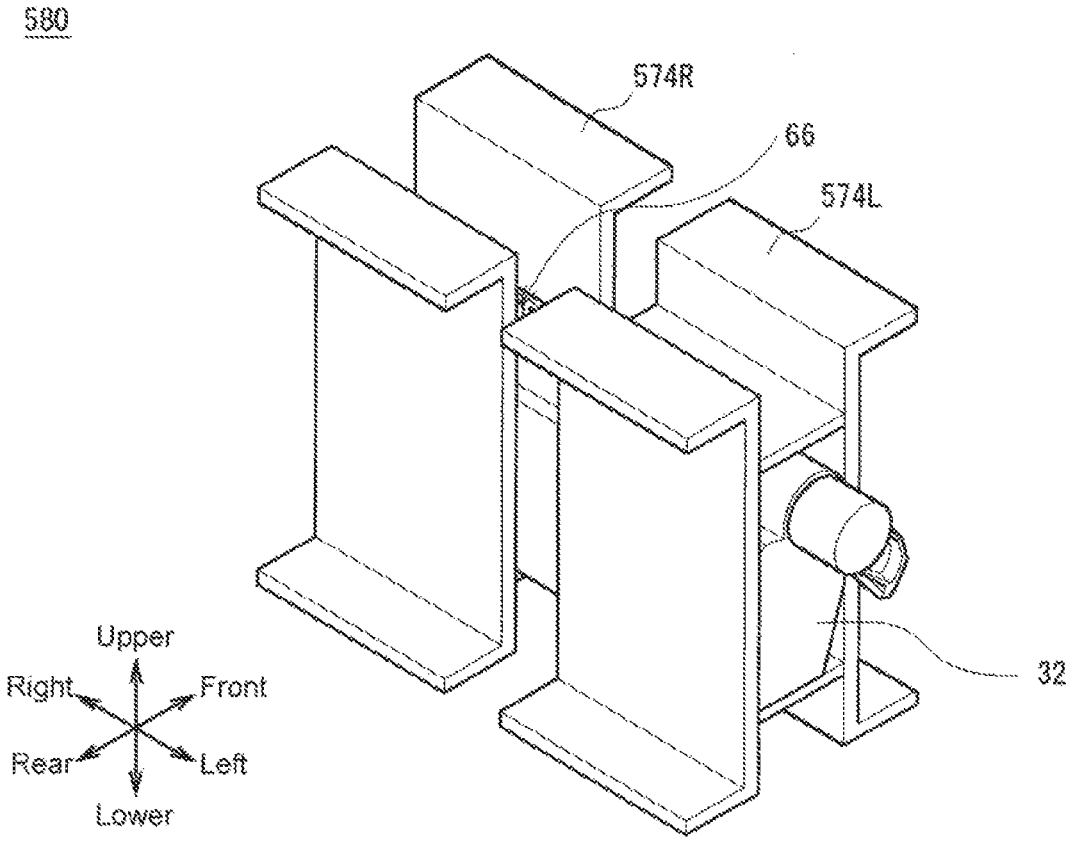
FIG. 16 is a perspective view illustrating a toner cartridge with a cushioning material of a comparative example.

FIG. 16 illustrates toner cartridge 580 with cushioning material as a comparative example. Toner cartridge 580 with cushioning material is stored in packing box 76 (FIG. 5) with cushioning material 574L and cushioning material 574R fitted at both ends in a left-right direction that is a longitudinal direction of toner cartridge 32.

Figure 17:
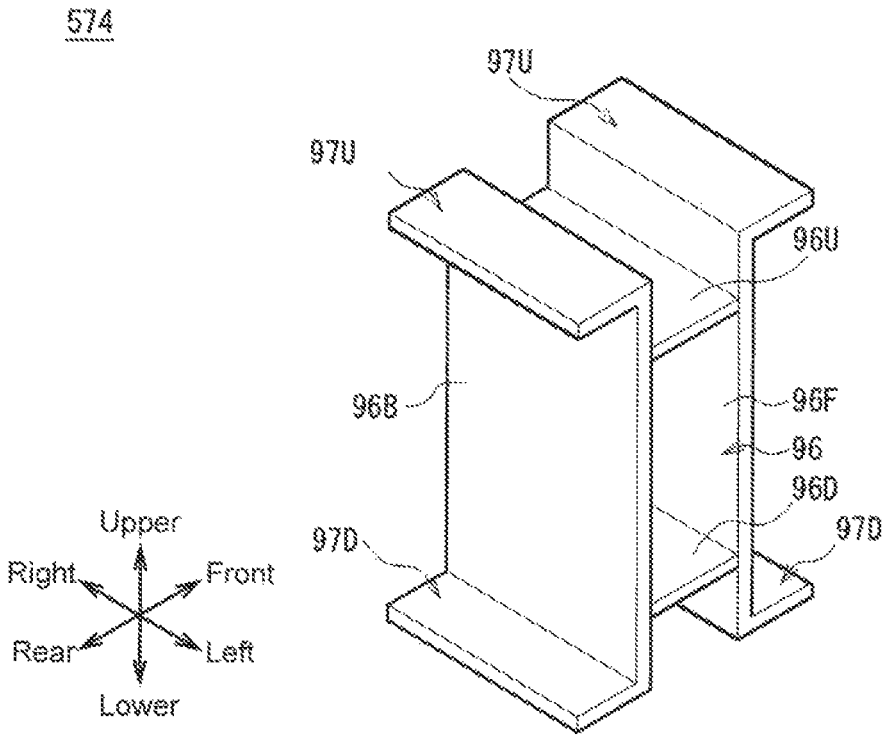
FIG. 17 is a perspective view illustrating the cushioning material of the comparative example.

As illustrated in FIG. 17, cushioning material 574 (574L and 574R) is formed in an approximately H-shape, and includes plate-like holding section top panel 96U and holding section bottom panel 96D and U-shaped holding section front panel 96F and holding section back panel 96B.

In cushioning material 574, holding section 96 is formed in a rectangular parallelepiped box shape with openings at the right and left sides. Holding section 96 is surrounded by holding section top panel 96U, holding section bottom panel 96D, holding section front panel 96F and holding section back panel 96B.

Cushioning material 574 also has L-shaped upper leg part 97U formed by bending upper ends of holding section front panel 96F and holding section back panel 96B at a right angle. Upper leg part 97U comes into contact with box top panel 76U of packing box 76 (FIG. 5). Furthermore, cushioning material 574 has L-shaped lower leg part 97D formed by bending lower ends of holding section front panel 96F and holding section back panel 96B at a right angle. Lower leg part 97D comes into contact with box bottom panel 76D of packing box 76.

Cushioning material 574 holds toner cartridge 32 with toner supply port 66 facing upward inside holding section 96 such that holding section top panel 96U comes into contact with toner supply port 66. Thus, toner cartridge 32 is held in a hanging state inside packing box 76. Accordingly, cushioning material 574 reduces the impact on toner cartridge 32 when packing box 76 is dropped.

However, when toner cartridge 580 with cushioning material is dropped with toner supply port 66 of toner cartridge 32 facing downward, any impact is directly applied to toner supply port 66 from holding section top panel 96U through upper leg part 97U. As a result, toner supply port 66 is deformed, leading to a possibility that the toner leaks to the outside through a gap generated between toner supply port 66 and shutter 68.

On the other hand, cushioning material 74 according to this embodiment fixes the position of toner cartridge 32 inside packing box 76 by allowing front-side tucking panel 88F and back-side tucking panel 88B to come into contact with cartridge front contact surface 54F and cartridge back contact surface 54B while protecting toner supply port 66 so as not to come into direct contact with toner supply port 66.

Thus, cushioning material 74 can prevent any impact on toner supply port 66 through cushioning material 74 when packing box 76 is dropped. Cushioning material 74 can also maintain upper space SPU by restricting the movement of toner cartridge 32 toward box top panel 76U, and prevent toner supply port 66 as a protection target part from hitting against box top panel 76U.

Moreover, in cushioning material 74, front-side tucking panel 88F and back-side tucking panel 88B are formed to have a horizontal length of about ⅓ to ⅔ of that of toner cartridge 32 in the cartridge width direction.

Here, when the horizontal length of front-side tucking panel 88F and back-side tucking panel 88B is too long, the worker needs great force to fold front-side tucking panel 88F and back-side tucking panel 88B (FIG. 13), leading to a reduction in work efficiency.

On the other hand, when the horizontal length of front-side tucking panel 88F and back-side tucking panel 88B is too short, front-side tucking panel 88F and back-side tucking panel 88B cannot withstand the impact and are deformed when packing box 76 is dropped. This can cause toner supply port 66 to hit against box top panel 76U.

For this reason, front-side tucking panel 88F and back-side tucking panel 88B are designed to have a horizontal length of about ⅓ to ⅔ of that of toner cartridge 32 in the cartridge width direction, which can withstand the impact when packing box 76 is dropped without lowering the work efficiency in building cushioning material 74.

Furthermore, in cushioning material 74, front-side tucking panel 88F and back-side tucking panel 88B are locked to cartridge front contact surface 54F and cartridge back contact surface 54B in a state of having a folding angle AG1 of 20 degrees or less relative to cushioning material front panel 74F and cushioning material back panel 74B (i.e., box front panel 76F and box back panel 76B), respectively.

Here, when folding angle AG1 exceeds 20 degrees, such as 45 degrees, for example, cushioning material front panel 74F and cushioning material back panel 74B are turned inward in the front-back direction so as to come close to each other with front-side folding part 90F and back-side folding part 90B as supporting points in a direction in which folding angle AG1 is increased, when packing box 76 is dropped. As a result, there is a possibility that front-side tucking panel 88F and back-side tucking panel 88B come off cartridge front contact surface 54F and cartridge back contact surface 54B and toner supply port 66 hits against box top panel 76U.

On the other hand, in cushioning material 74 according to this embodiment, folding angle AG1 of front-side tucking panel 88F and back-side tucking panel 88B relative to box front panel 76F and box back panel 76B is set to 20 degrees or less, respectively.

Thus, cushioning material 74 can prevent cushioning material front panel 74F and cushioning material back panel 74B from turning so as to come close to each other when packing box 76 is dropped. Cushioning material 74 can also maintain upper space SPU by restricting the movement of toner cartridge 32 toward box top panel 76U, and thus prevent toner supply port 66 from hitting against box top panel 76U.

Furthermore, in cushioning material 74, front-side tucking panel 88F and back-side tucking panel 88B are formed so as to be folded at front-side folding part 90F and back-side folding part 90B. Thus, resilient forces Ff and Fb allow front-side tucking panel 88F and back-side tucking panel 88B to come into contact with cartridge front-side locking part 55F and the rear side surface of convex part 64, respectively.

As a result, when packing box 76 is dropped, cushioning material 74 can prevent cushioning material front panel 74F and cushioning material back panel 74B from turning outward in the front-back direction so as to separate from each other with front-side folding part 90F and back-side folding part 90B as supporting points in a direction in which folding angle AG1 is reduced.

Accordingly, cushioning material 74 can prevent cushioning material front panel 74F and cushioning material back panel 74B from entering into front-side space SPF and back-side space SPB and coming off cartridge front contact surface 54F and cartridge back contact surface 54B. Cushioning material 74 can also maintain upper space SPU by restricting the movement of toner cartridge 32 toward box top panel 76U, and thus prevent toner supply port 66 from hitting against box top panel 76U.

Furthermore, cushioning material 74 locks back-side locking part 92B to cartridge back contact surface 54B separated from back-side folding part 90B below convex part central axis 62.

More specifically, back-side locking part 92B comes into contact with a portion which is positioned below convex part back end 64B protruding most backward in the curved shape of convex part 64 of toner cartridge 32 and slightly in front of convex part back end 64B, and is curved so as to be tilted from back to front in the direction from top to bottom.

Here, assuming that cartridge back contact surface 54B is formed above convex part central axis 62 (closer to supply port side end 59), cushioning material back panel 74B is turned forward with back-side folding part 90B as the supporting point in a direction in which folding angle AG1 is increased, when packing box 76 is dropped and cartridge back contact surface 54B applies force to back-side tucking panel 88B of cushioning material 74. As a result, there is a possibility that back-side tucking panel 88B comes off cartridge back contact surface 54B and toner supply port 66 hits against box top panel 76U.

On the other hand, cushioning material 74 according to this embodiment locks back-side locking part 92B to cartridge back contact surface 54B separated from back-side folding part 90B below convex part central axis 62.

With this configuration, cushioning material 74 can prevent cushioning material back panel 74B from turning forward when packing box 76 is dropped. Cushioning material 74 can also maintain upper space SPU by restricting the movement of toner cartridge 32 toward box top panel 76U, and thus prevent toner supply port 66 from hitting against box top panel 76U.

Furthermore, cushioning material 74 uses cartridge front contact surface 54F and cartridge back contact surface 54B to fix the position of toner cartridge 32. Cartridge front contact surface 54F and cartridge back contact surface 54B, originally formed in steps to position toner cartridge 32 relative to developing device 30, are flat surfaces facing box top panel inner surface 76 UI.

Thus, cushioning material 74 can fix the position of toner cartridge 32 by utilizing the shape of outer cartridge 58 without changing the shape of outer cartridge 58 so as not to apply impact on toner supply port 66 of toner cartridge 32. Accordingly, cushioning material 74 can have a simple configuration.

Since toner cartridge 32 is just an expendable item, the cushioning material to protect toner cartridge 32 is required to be low in cost without complex configuration.

In this regard, cushioning material 74 according to this embodiment can be manufactured at low cost since only one cardboard sheet is used to form the cushioning material. Moreover, an impact on toner supply port 66 of toner cartridge 32 can be prevented with a very simple configuration.

According to the above configuration, packing device 77 as a packing device includes packing box 76 and cushioning material 74. Packing box 76 stores toner cartridge 32 as a packing target object in the internal space thereof, and has box top panel inner surface 76UI as a packing box inner surface that is at least one surface. When stored in the internal space of packing box 76 together with toner cartridge 32, cushioning material 74 comes into contact with box top panel inner surface 76UI and cartridge front contact surface 54F and cartridge back contact surface 54B as the contact surfaces formed in toner cartridge 32 and facing the box top panel inner surface, so as not to come into contact with toner supply port 66 as a protection target part formed at a position facing box top panel inner surface 76UI of packing box 76 in toner cartridge 32. Furthermore, cushioning material 74 holds upper space SPU as a space between toner supply port 66 of toner cartridge 32 and box top panel inner surface 76UI.

With this configuration, packing device 77 can restrict the movement of toner cartridge 32 toward box top panel inner surface 76UI without coming into contact with toner supply port 66, and thus can prevent transmission of impact to toner supply port 66 of toner cartridge 32 through cushioning material 74.

2. Second Embodiment

Figure 18:
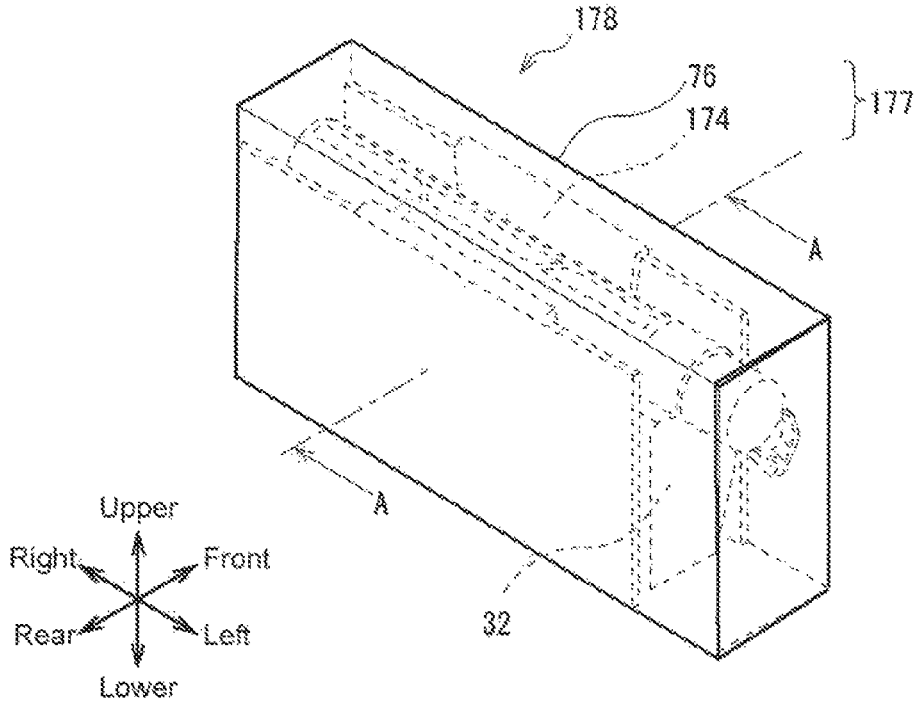
FIG. 18 is a perspective view illustrating a configuration of a package according to a second embodiment.
Figure 19:
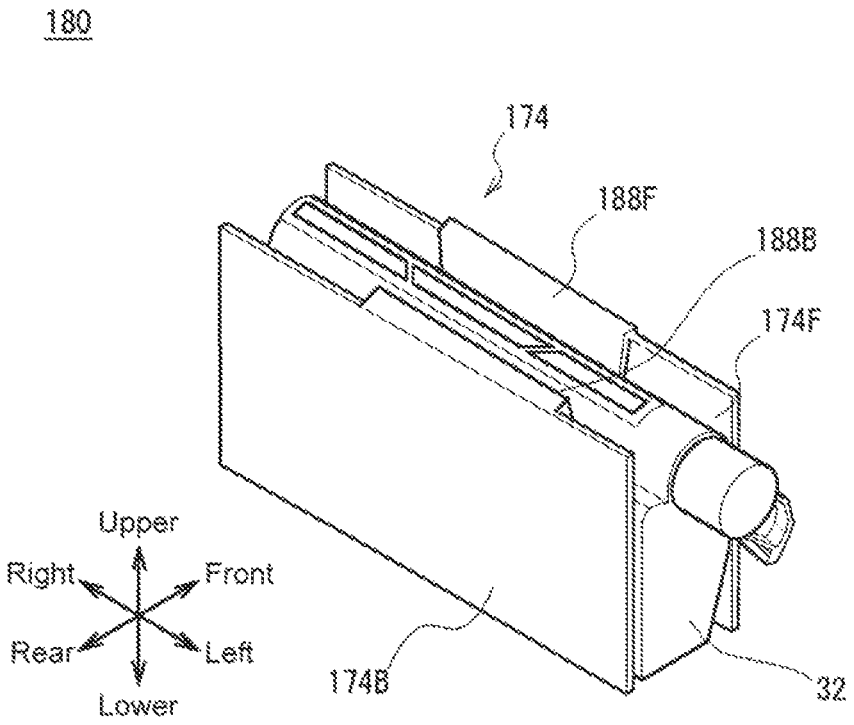
FIG. 19 is a perspective view illustrating a configuration of a toner cartridge with a cushioning material according to the second embodiment.

Package 178 according to a second embodiment illustrated in FIG. 18 has the same configuration as that of package 78 (FIG. 5) according to the first embodiment, except that cushioning material 174 illustrated in FIG. 19 is different from cushioning material 74.

[2-1. Configuration of Cushioning Material]

Figure 20B:
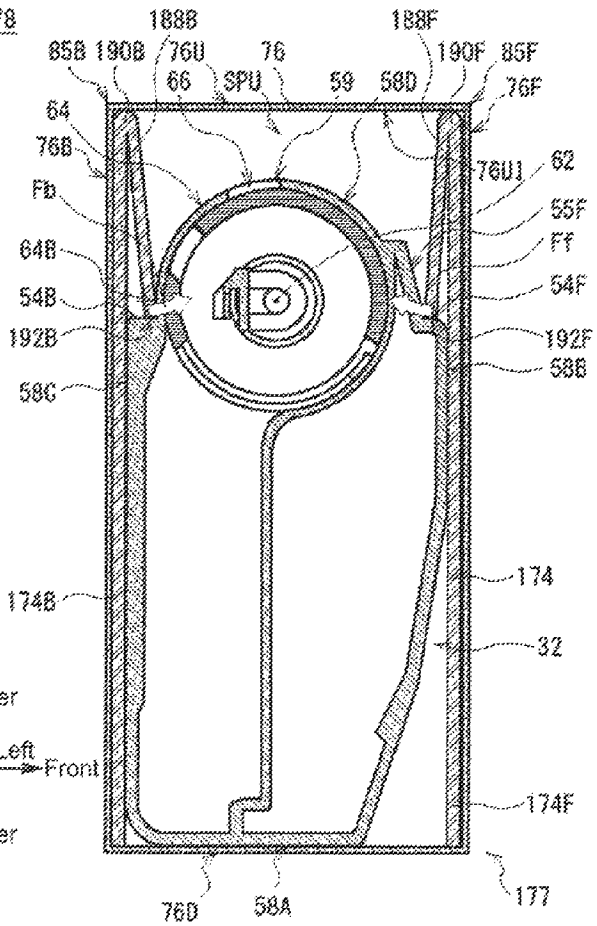
FIG. 20A is a left side view and FIG. 20B is a cross-sectional view taken along the line indicated by the arrows A-A in FIG. 18, illustrating the configuration of the package according to the second embodiment.
Figure 20A:
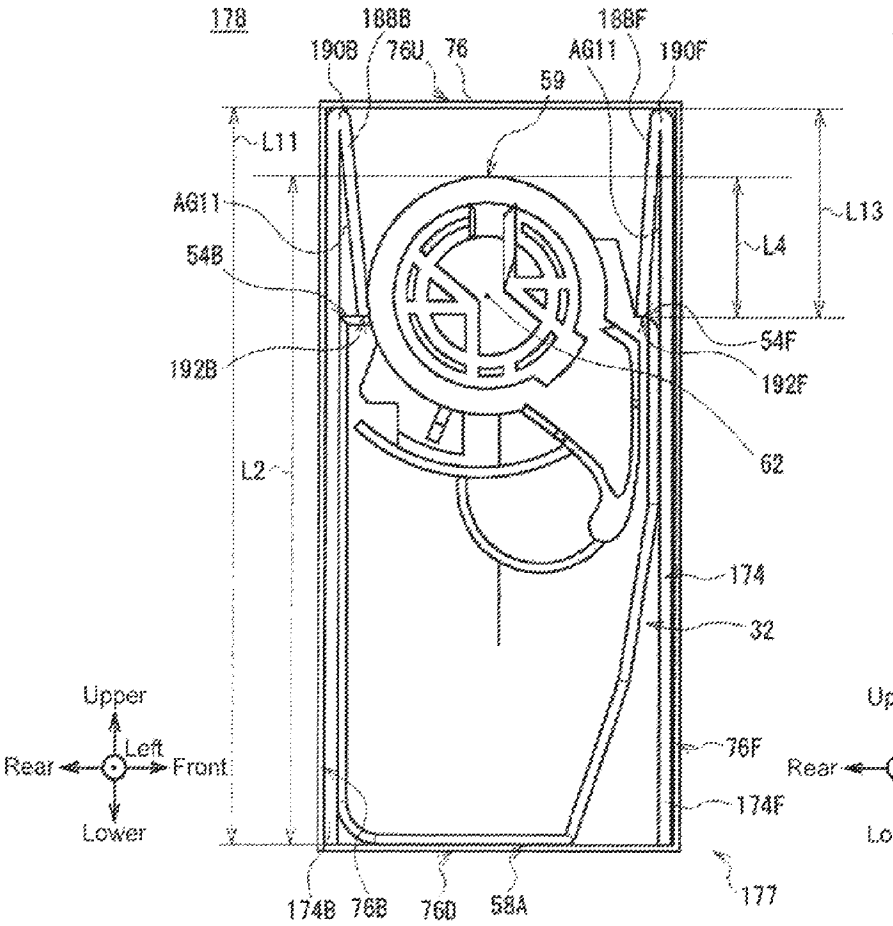

As illustrated in FIG. 20, cushioning material 174 includes only cushioning material front panel 174F and cushioning material back panel 174B by omitting tube part 86 and cushioning material bottom panel 74D in cushioning material 74.

A front side surface of cushioning material front panel 174F comes into contact with a rear side surface of box front panel 76F, and a rear side surface thereof comes into contact with cartridge front side surface 58B. A rear side surface of cushioning material back panel 174B comes into contact with a front side surface of box back panel 76B, and a front side surface thereof comes into contact with cartridge rear side surface 58C. Container side surface 58A of toner cartridge 32 comes into direct contact with box bottom panel 76D.

Cushioning material front panel 174F and cushioning material back panel 174B are folded backward and forward, respectively, at front-side folding part 190F and back-side folding part 190B positioned at upper ends thereof. Thus, front-side tucking panel 188F and back-side tucking panel 188B are formed.

Front-side folding part 190F and back-side folding part 190B come into contact with the inside of box upper front corner 85F and box upper back corner 85B of packing box 76, respectively.

Front-side locking part 192F and back-side locking part 192B, provided at respective lower ends of front-side tucking panel 188F and back-side tucking panel 188B, are locked to cartridge front contact surface 54F and cartridge back contact surface 54B.

As described above, cushioning material 174 restricts upward movement of toner cartridge 32 by allowing the upper end of front-side tucking panel 188F to come into contact with box upper front corner 85F and the lower end thereof to come into contact with cartridge front contact surface 54F and by allowing the upper end of back-side tucking panel 188B to come into contact with box upper back corner 85B and the lower end thereof to come into contact with cartridge back contact surface 54B.

In this state, front-side tucking panel 188F and back-side tucking panel 188B have a folding angle AG11 of 20 degrees or less relative to cushioning material front panel 174F and cushioning material back panel 174B (i.e., box front panel 76F and box back panel 76B), respectively.

Vertical length L11 from box bottom panel 76D to upper ends of cushioning material front panel 174F and cushioning material back panel 174B (i.e., the height of cushioning material front panel 174F and cushioning material back panel 174B) is set longer than vertical length L2 from box bottom panel 76D to supply port side end 59 of toner cartridge 32 (i.e., the height of toner cartridge 32).

Also, vertical length L13 from box top panel 76U to front-side locking part 192F and back-side locking part 192B (i.e., the height of front-side tucking panel 188F and back-side tucking panel 188B) is set longer than vertical length L4 from supply port side end 59 to cartridge front contact surface 54F and cartridge back contact surface 54B.

For this reason, upper space SPU is formed between toner supply port 66 of toner cartridge 32 and box top panel inner surface 76UI of packing box 76.

With this configuration, cushioning material 174 prevents toner supply port 66 of toner cartridge 32 from coming into contact with box top panel 76U when package 178 is dropped.

As described above, cushioning material 174 supports toner cartridge 32 without coming into direct contact with toner supply port 66, thereby fixing the position of toner cartridge 32 inside packing box 76 and maintaining upper space SPU.

[2-2. Packing Method]

Cushioning material 174 described above is built through the following steps to pack toner cartridge 32, and is stored in packing box 76.

Figure 21:
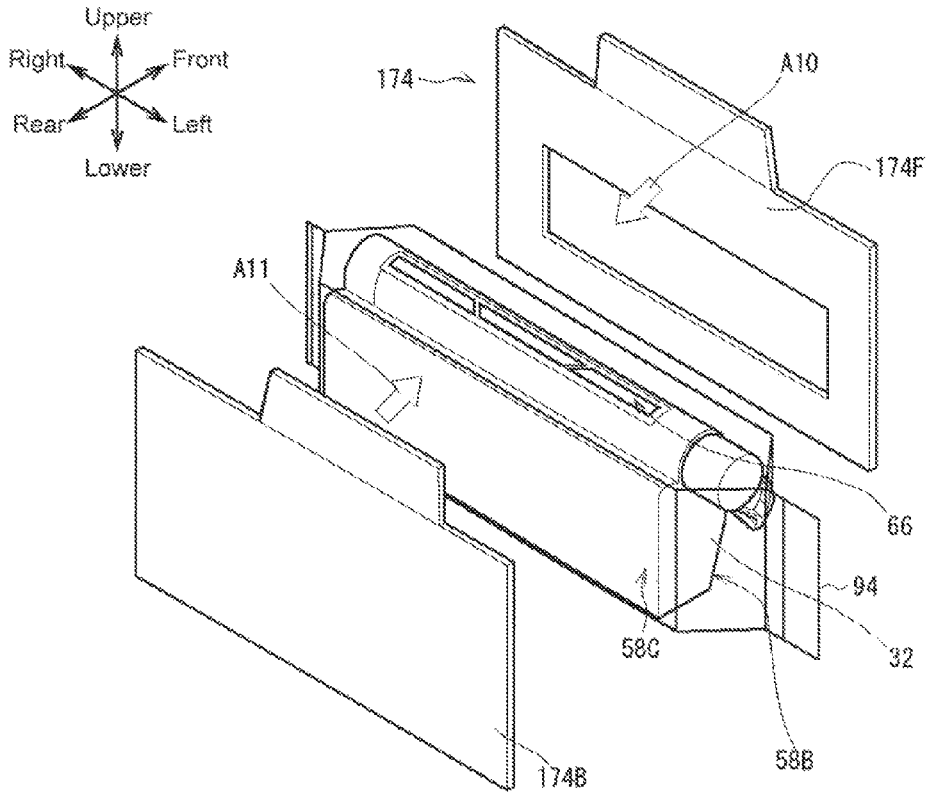
FIG. 21 is a perspective view illustrating a step (1) of packing according to the second embodiment.

FIG. 21 illustrates cushioning material 174 before being built up. Cushioning material 174 (174F and 174B) is formed by cutting a cardboard sheet into a predetermined sheet shape with folding lines and slits provided at predetermined positions.

As illustrated in FIG. 21, the worker allows cushioning material front panel 174F to come into contact with cartridge front side surface 58B of toner cartridge 32 along arrow direction A10 and also allows cushioning material back panel 174B to come into contact with cartridge rear side surface 58C along arrow direction A11. Here, toner cartridge 32 is packaged in moisture-proof bag 94 and in a state of having toner supply port 66 facing upward. Note that moisture-proof bag 94 is omitted in the drawings other than in FIG. 21.

Figure 22:
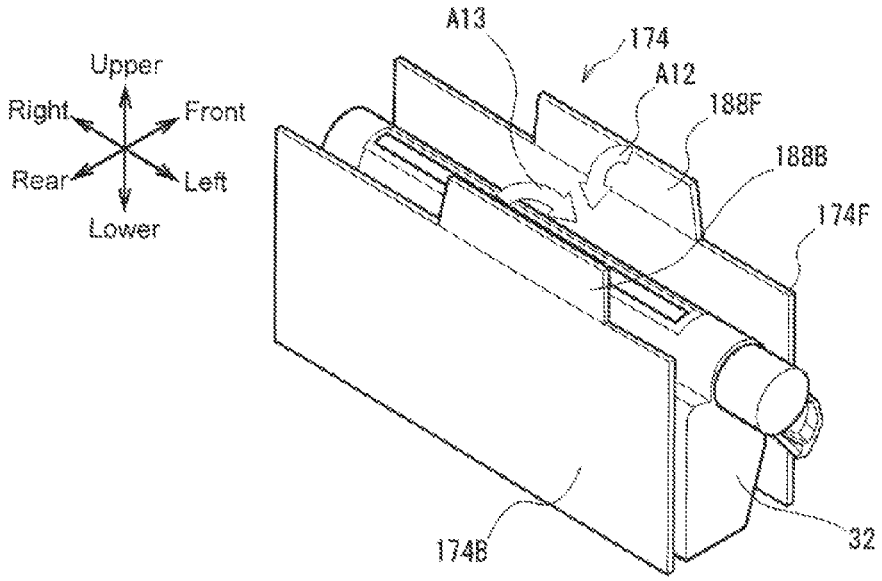
FIG. 22 is a perspective view illustrating a step (2) of packing according to the second embodiment.
Figure 23:
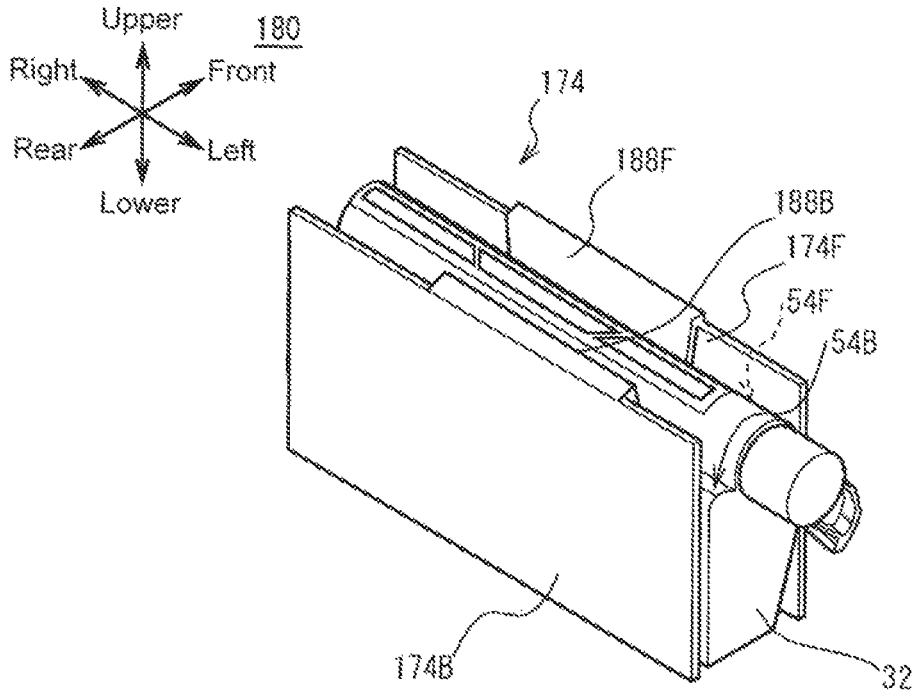
FIG. 23 is a perspective view illustrating a step (3) of packing according to the second embodiment.

Then, as illustrated in FIG. 22, the worker folds front-side tucking panel 188F inward toward toner cartridge 32 along arrow direction A12 and also folds back-side tucking panel 188B inward toward toner cartridge 32 along arrow direction A13. Thus, front-side tucking panel 188F and back-side tucking panel 188B are locked to cartridge front contact surface 54F and cartridge back contact surface 54B, respectively, as illustrated in FIG. 23. Accordingly, cushioning material 174 is built up to pack toner cartridge 32.

Figure 24:
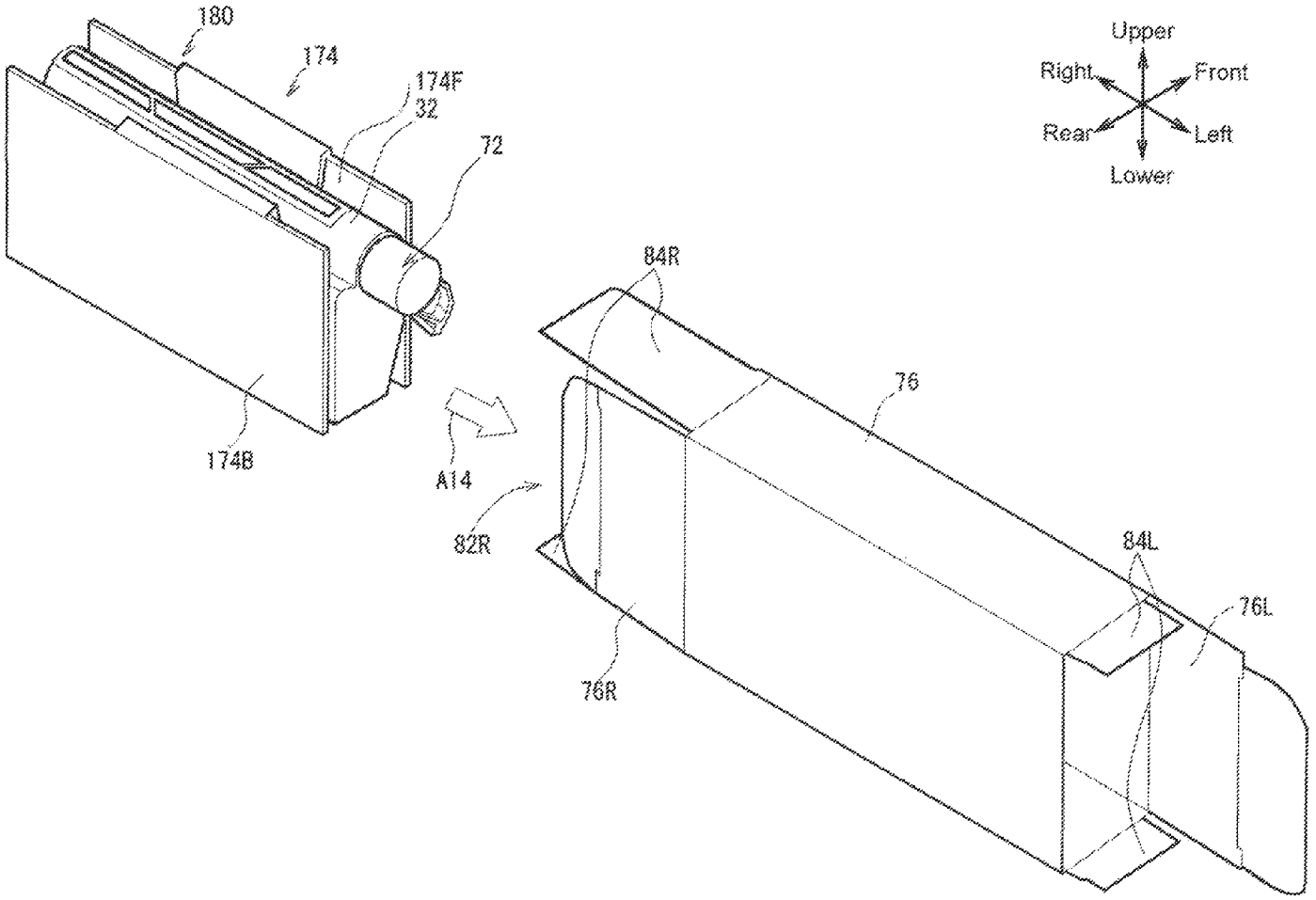
FIG. 24 is a perspective view illustrating a step (4) of packing according to the second embodiment.

Thereafter, the worker prevents cushioning material 174 from losing its shape by being pressed inward on cushioning material front panel 174F and cushioning material back panel 174B. Meanwhile, the worker puts toner cartridge 180 with cushioning material into packing box 76 through right-side opening 82R of packing box 76 from the operation lever 72 side along arrow direction A14 as illustrated in FIG. 24.

Subsequently, the worker engages cushioning material 174 with packing box 76 as illustrated in FIG. 18 by closing left-side lid 76L and right-side lid 76R after folding inward left-side folding panels 84L and right-side folding panels 84R of packing box 76.

Thus, cushioning material 174 is built so as to hold toner cartridge 32 thereinside. Toner cartridge 180 with cushioning material is put inside packing box 76 and is thus set in a transportable state.

According to the above configuration, tube part 86 and cushioning material bottom panel 74D of cushioning material 74 in packing device 77 are omitted from packing device 177. Thus, compared with cushioning material 74, the configuration of cushioning material 174 can be simplified by omitting some members, and costs can be reduced.

Moreover, cushioning material 174 makes it possible to omit the step of building tube part 86 (FIGS. 9 and 10) and the step of lifting cushioning material front panel 74F and cushioning material back panel 74B from cushioning material bottom panel 74D (FIG. 11) as compared to cushioning material 74. Thus, the number of steps required for the worker to build the cushioning material can be reduced.

Besides the above, packing device 177 according to the second embodiment can achieve the same advantageous effects as those achieved by packing device 77 according to the first embodiment.

3. Third Embodiment

Figure 25:
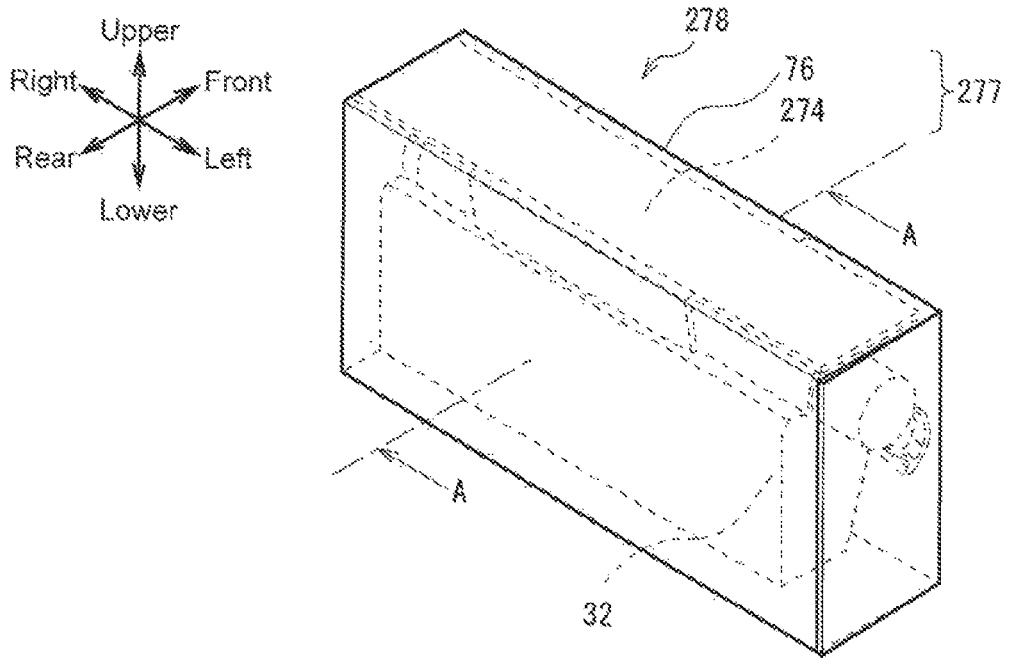
FIG. 25 is a perspective view illustrating a configuration of a package according to a third embodiment.
Figure 26:
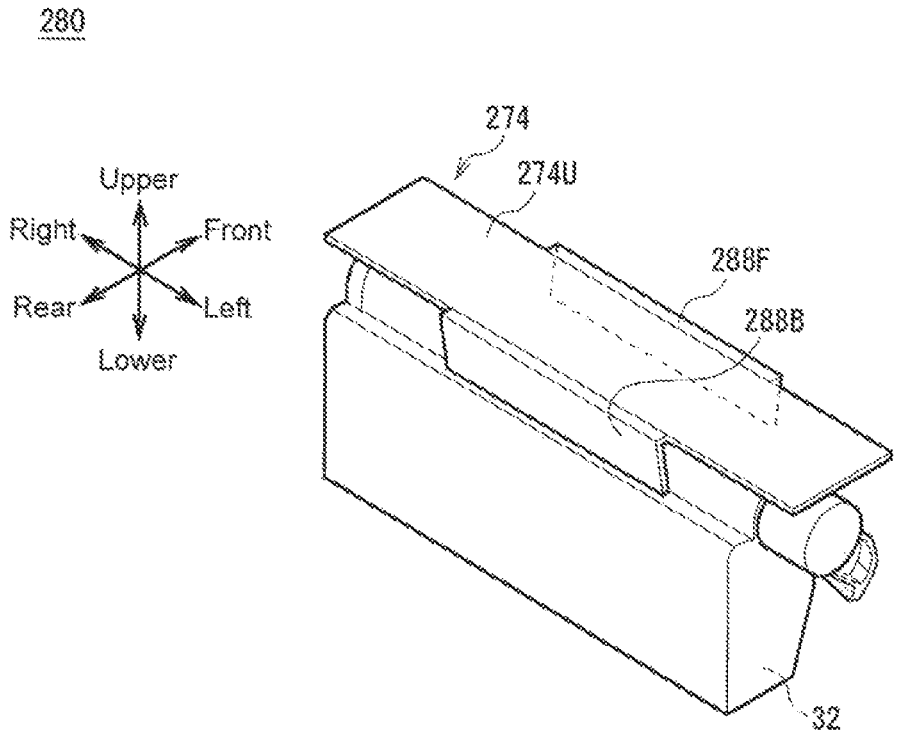
FIG. 26 is a perspective view illustrating a configuration of a toner cartridge with a cushioning material according to the third embodiment.

Package 278 according to a third embodiment illustrated in FIG. 25 has the same configuration as that of package 78 (FIG. 5) according to the first embodiment, except that cushioning material 274 illustrated in FIG. 26 is different from cushioning material 74.

[3-1. Configuration of Cushioning Material]

Figure 27B:
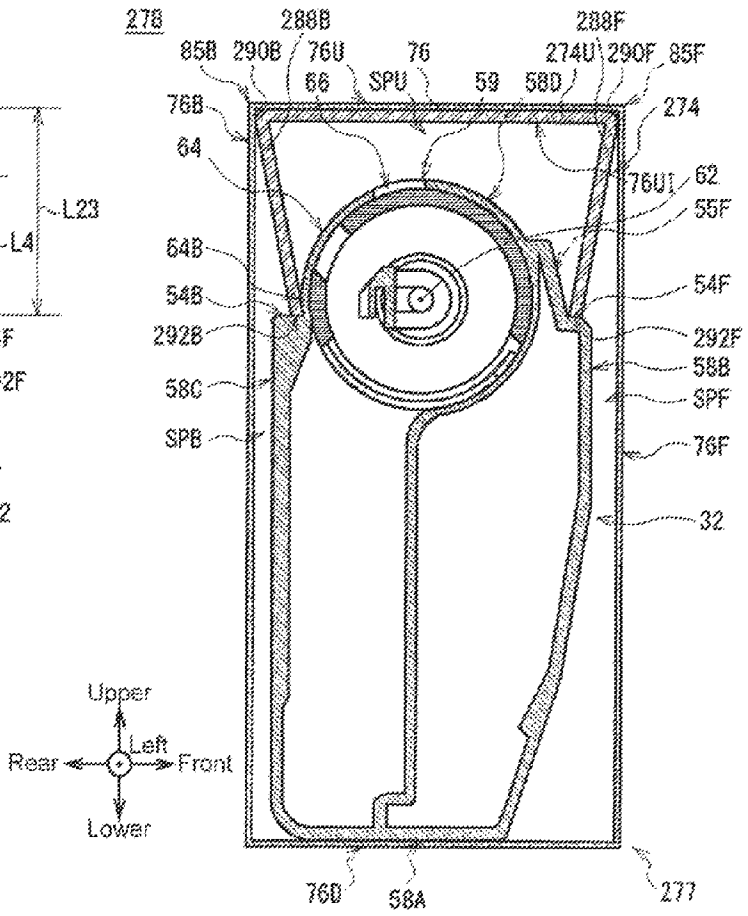
FIG. 27A is a left side view and FIG. 27B is a cross-sectional view taken along the line indicated by the arrows A-A in FIG. 25, illustrating the configuration of the package according to the third embodiment.
Figure 27A:
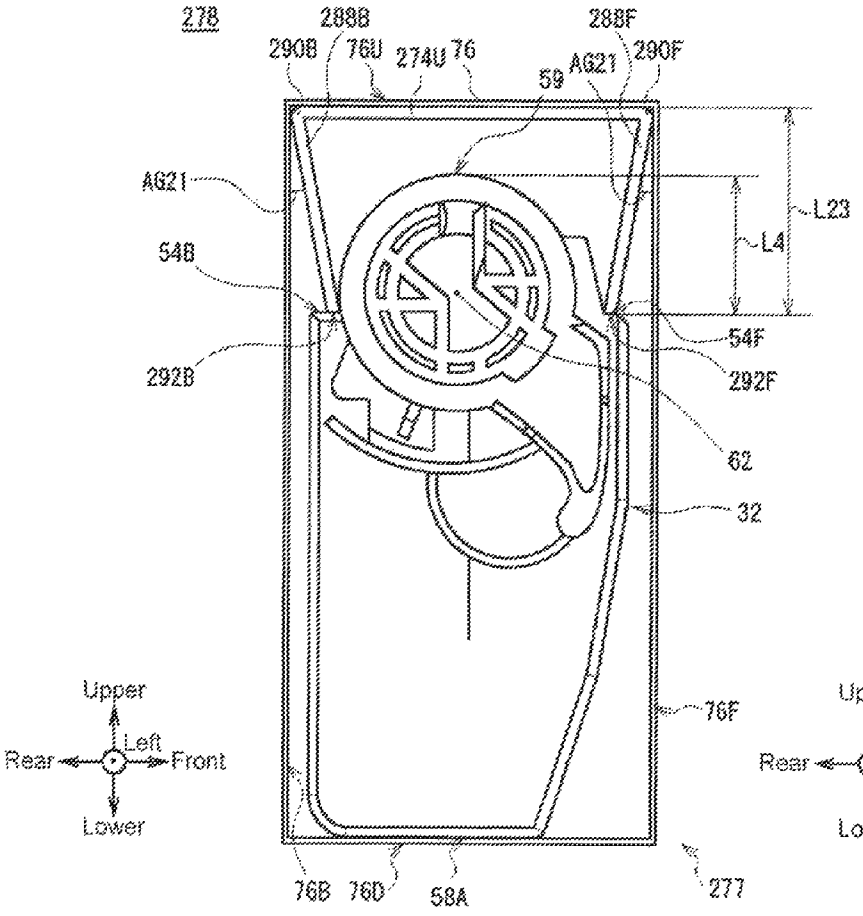

As illustrated in FIG. 27, cushioning material 274 includes only cushioning material top panel 274U. Cushioning material top panel 274U is formed to have horizontal and longitudinal lengths slightly shorter than those of box top panel 76U of packing box 76. An upper side surface of cushioning material top panel 274U comes into contact with box top panel inner surface 76UI, and a lower side surface thereof faces supply port side surface 58D of toner cartridge 32 across upper space SPU.

Cushioning material top panel 274U is folded backward and forward at front-side folding part 290F and back-side folding part 290B positioned at a front end thereof. Thus, front-side tucking panel 288F and back-side tucking panel 288B are formed.

Front-side folding part 290F and back-side folding part 290B come into contact with the inside of box upper front corner 85F and box upper back corner 85B, respectively.

Front-side tucking panel 288F and back-side tucking panel 288B are formed to have a horizontal length of about ⅓ to ⅔ of that of toner cartridge 32 in the cartridge width direction, and to have a vertical length approximately ⅓ of that of toner cartridge 32 in the cartridge height direction.

Front-side locking part 292F and back-side locking part 292B provided at respective lower ends of front-side tucking panel 288F and back-side tucking panel 288B are locked to cartridge front contact surface 54F and cartridge back contact surface 54B.

As described above, cushioning material 274 restricts upward movement of toner cartridge 32 by allowing the upper end of front-side tucking panel 288F to come into contact with box upper front corner 85F and the lower end thereof to come into contact with cartridge front contact surface 54F, and by allowing the upper end of back-side tucking panel 288B to come into contact with box upper back corner 85B and the lower end thereof to come into contact with cartridge back contact surface 54B.

In this state, front-side tucking panel 288F and back-side tucking panel 288B have a folding angle AG21 of 20 degrees or less relative to box front panel 76F and box back panel 76B, respectively.

Vertical length L23 from box top panel 76U to front-side locking part 292F and back-side locking part 292B (i.e., the height of front-side tucking panel 288F and back-side tucking panel 288B) is set longer than vertical length L4 from supply port side end 59 to cartridge front contact surface 54F and cartridge back contact surface 54B.

For this reason, upper space SPU is formed between toner supply port 66 of toner cartridge 32 and box top panel inner surface 76UI of packing box 76.

With this configuration, cushioning material 274 prevents toner supply port 66 of toner cartridge 32 from coming into contact with box top panel 76U when package 278 is dropped.

As described above, cushioning material 274 supports toner cartridge 32 without coming into direct contact with toner supply port 66, thereby fixing the position of toner cartridge 32 inside packing box 76 and maintaining upper space SPU.

[3-2. Packing Method]

Cushioning material 274 described above is built through the following steps to pack toner cartridge 32, and is stored in packing box 76.

Figure 28:
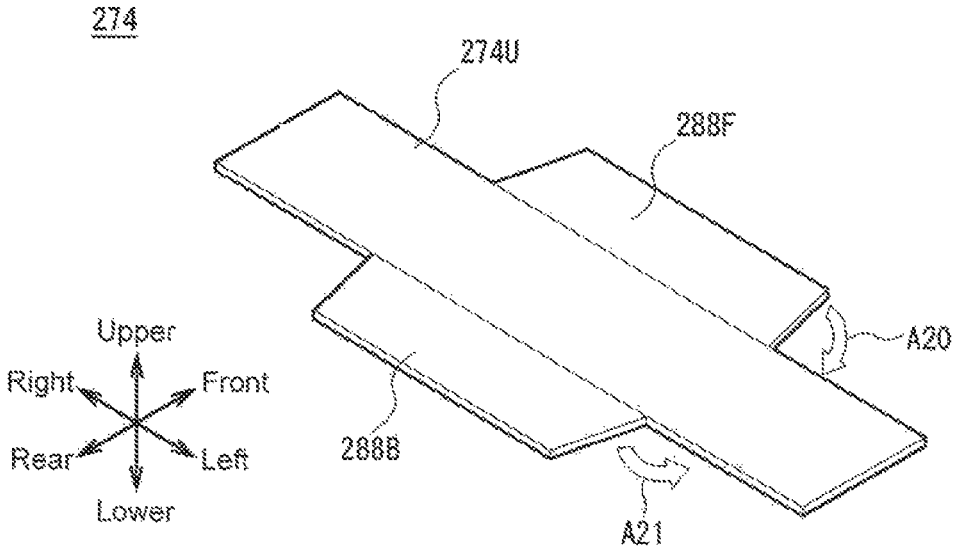
FIG. 28 is a perspective view illustrating a step (1) of packing according to a third embodiment.

FIG. 28 illustrates cushioning material 274 before being built up. Cushioning material 274 is formed by cutting a cardboard sheet into a predetermined sheet shape with folding lines and slits provided at predetermined positions.

As illustrated in FIG. 28, a worker folds front-side tucking panel 288F inward along arrow direction A20 from cushioning material top panel 274U, and folds back-side tucking panel 288B inward along arrow direction A21.

Figure 29:
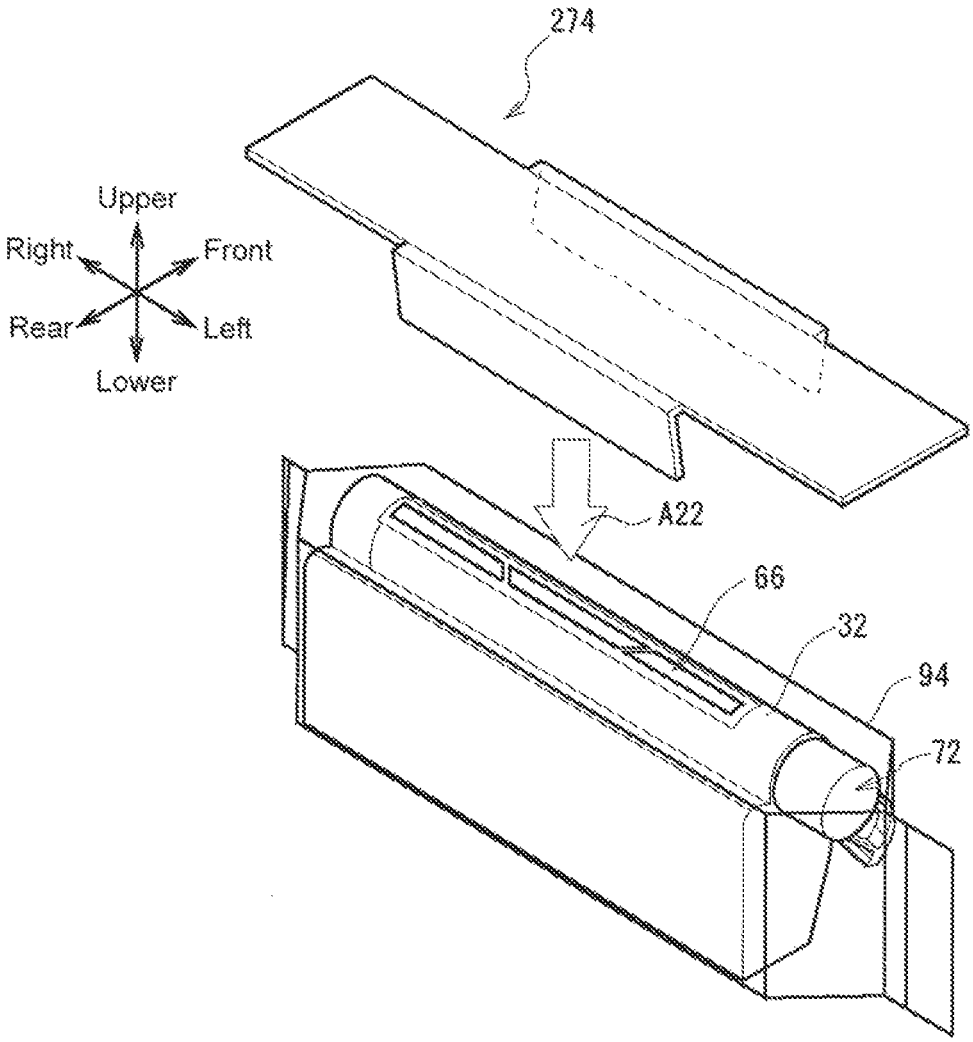
FIG. 29 is a perspective view illustrating a step (2) of packing according to the third embodiment.
Figure 30:
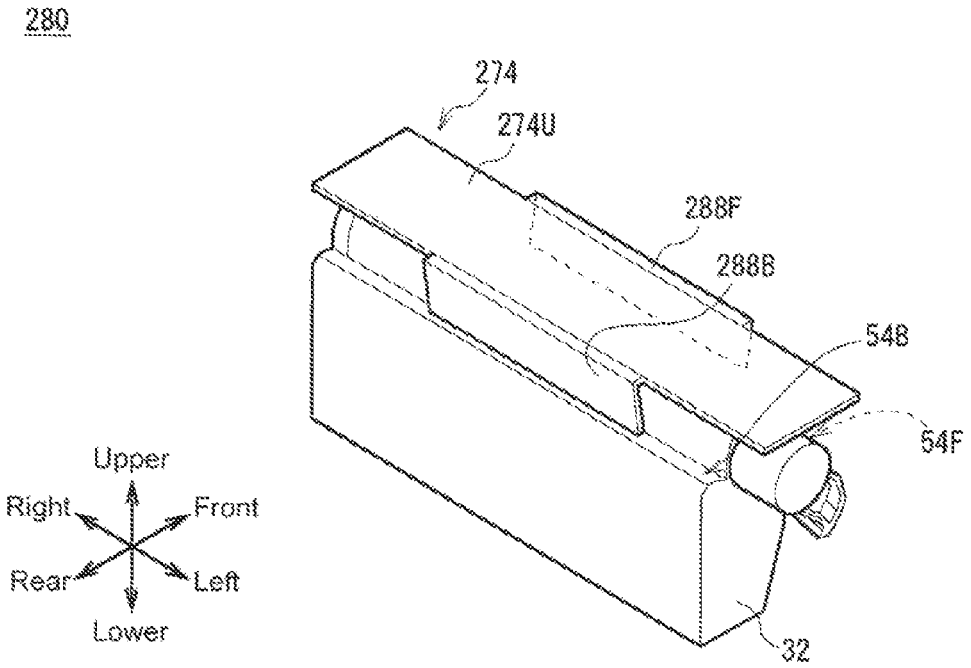
FIG. 30 is a perspective view illustrating a step (3) of packing according to the third embodiment.

Then, as illustrated in FIG. 29, the worker places cushioning material 274 along arrow direction A22 on toner cartridge 32 packaged in moisture-proof bag 94 with toner supply port 66 facing upward. Thereafter, as shown in FIG. 30, the worker locks front-side tucking panel 288F and back-side tucking panel 288B to cartridge front contact surface 54F and cartridge back contact surface 54B. Note that moisture-proof bag 94 is omitted in the drawings other than in FIG. 29.

Figure 31:
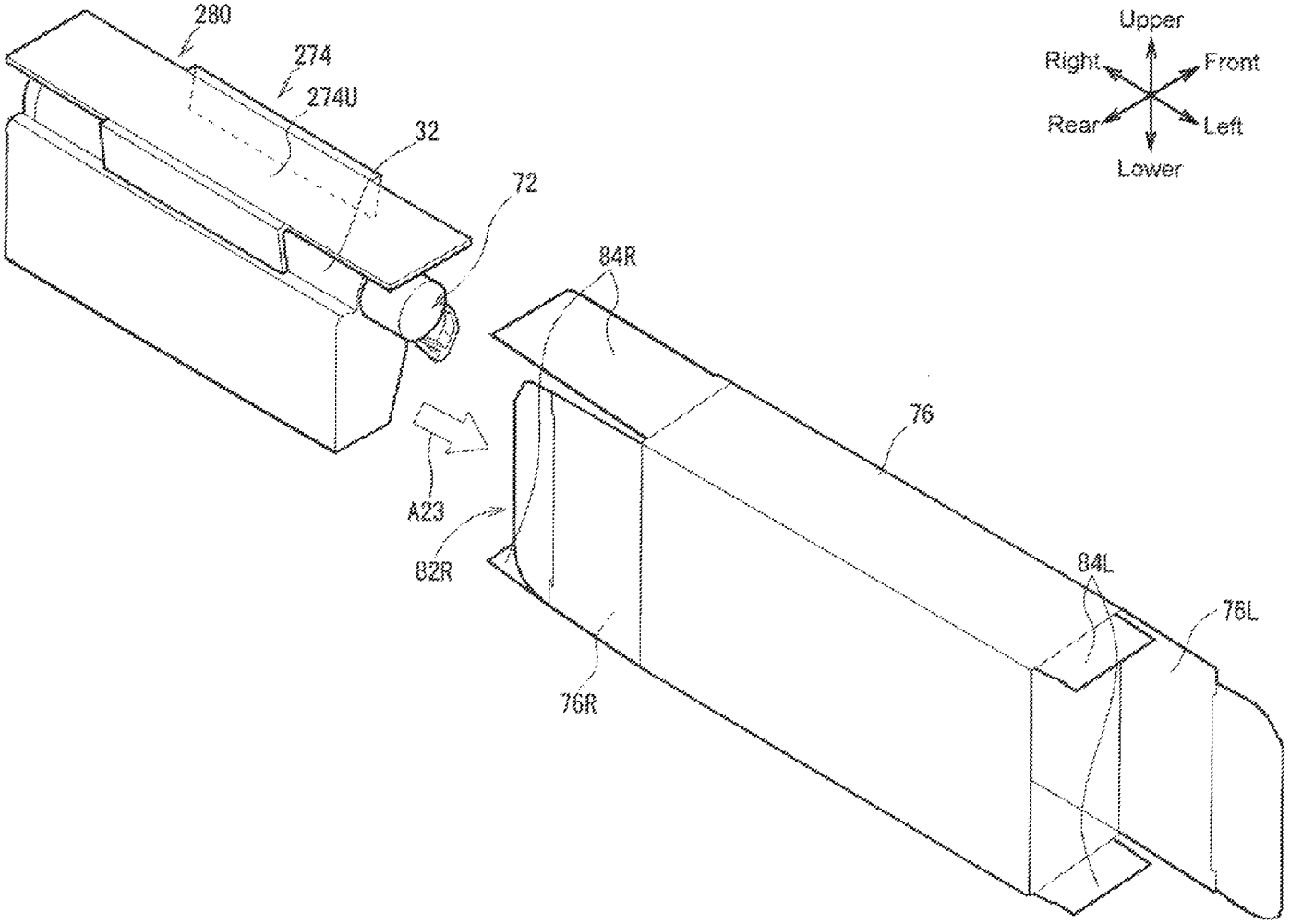
FIG. 31 is a perspective view illustrating a step (4) of packing according to the third embodiment.

Subsequently, the worker puts toner cartridge 280 with cushioning material into packing box 76 through right-side opening 82R of packing box 76 from the operation lever 72 side along arrow direction A23 as illustrated in FIG. 31 while preventing cushioning material 274 from losing its shape by being pressed downward on cushioning material top panel 274U.

Then, the worker engages cushioning material 274 with packing box 76 as illustrated in FIG. 25 by closing left-side lid 76L and right-side lid 76R after folding inward left-side folding panels 84L and right-side folding panels 84R of packing box 76.

Thus, cushioning material 274 is placed on toner cartridge 32, and toner cartridge 280 with cushioning material is put inside packing box 76 and is thus set in a transportable state.

According to the above configuration, cushioning material front panel 174F and cushioning material back panel 174B of cushioning material 174 in packing device 177 are omitted from packing device 277. Thus, compared with cushioning material 174 according to the second embodiment, the configuration of cushioning material 274 can be simplified by omitting more members, and therefore costs can be reduced.

Moreover, cushioning material 274 makes it possible to omit the step of building tube part 86 (FIGS. 9 and 10) and the step of lifting cushioning material front panel 74F and cushioning material back panel 74B from cushioning material bottom panel 74D (FIG. 11) as compared to cushioning material 74. Thus, the number of steps required for the worker to build the cushioning material can be reduced.

Besides the above, packing device 277 according to the third embodiment can achieve the same advantageous effects as those achieved by packing device 77 according to the first embodiment.

4. Fourth Embodiment

Figure 32B:
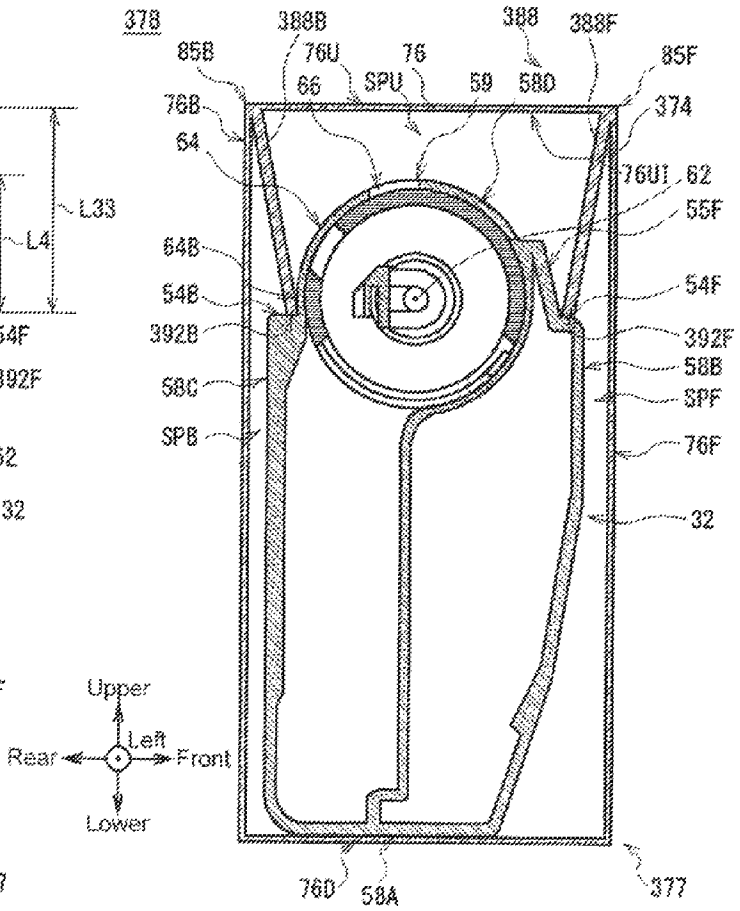
FIG. 32A is a left side view and FIG. 32B is a cross-sectional view, illustrating a configuration of a package according to a fourth embodiment.
Figure 32A:
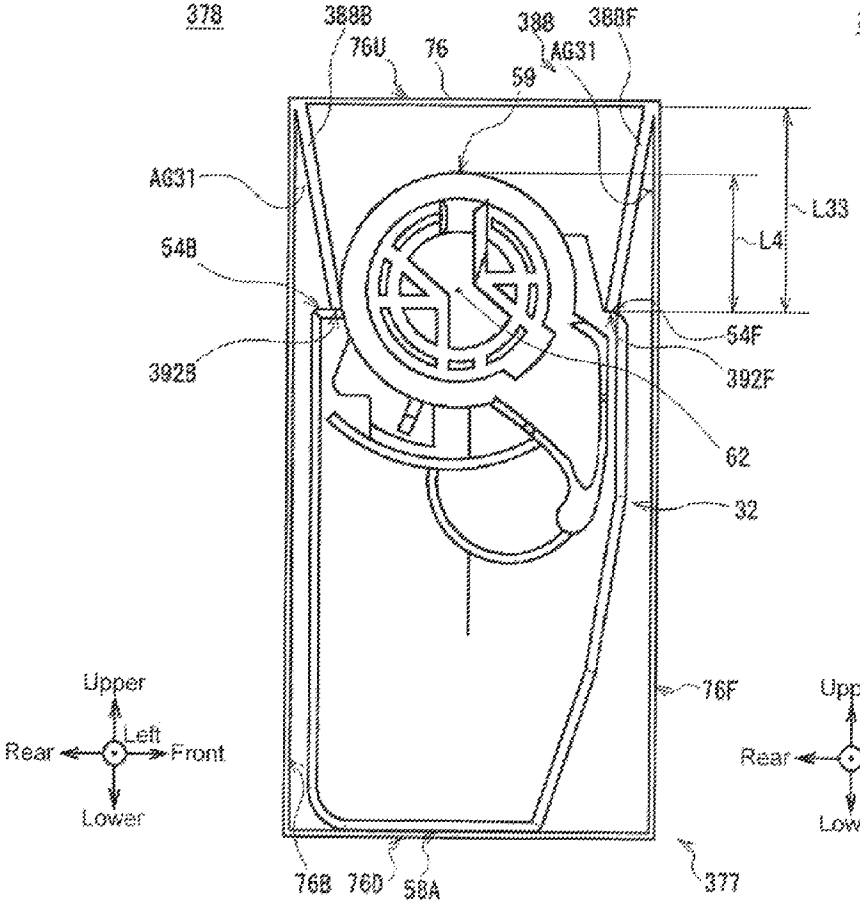

Package 378 according to a fourth embodiment illustrated in FIG. 32 has the same configuration as that of package 278 (FIG. 27) according to the third embodiment, except that cushioning material 374 is different from cushioning material 274. Cushioning material 374 is obtained by omitting cushioning material top panel 274U from cushioning material 274, and is integrated with packing box 76.

Front-side tucking panel 388F extends downward and backward from box upper front corner 85F, and front-side locking part 392F at a lower end thereof is locked to cartridge front contact surface 54F. Meanwhile, back-side tucking panel 388B extends downward and forward from box upper back corner 85B, and back-side locking part 392B at a lower end thereof is locked to cartridge back contact surface 54B. With this configuration, cushioning material 374 restricts upward movement of toner cartridge 32.

Front-side tucking panel 388F and back-side tucking panel 388B are formed to have a horizontal length of about ⅓ to ⅔ of that of toner cartridge 32 in the cartridge width direction, and to have a vertical length of approximately ⅓ of that of toner cartridge 32 in the cartridge height direction.

In this state, front-side tucking panel 388F and back-side tucking panel 388B have a folding angle AG31 of 20 degrees or less relative to box front panel 76F and box back panel 76B, respectively.

Vertical length L33 from box top panel 76U to front-side locking part 392F and back-side locking part 392B (i.e., the height of front-side tucking panel 388F and back-side tucking panel 388B) is set longer than vertical length L4 from supply port side end 59 to cartridge front contact surface 54F and cartridge back contact surface 54B.

For this reason, upper space SPU is formed between toner supply port 66 of toner cartridge 32 and box top panel inner surface 76UI of packing box 76.

With this configuration, cushioning material 374 prevents toner supply port 66 of toner cartridge 32 from coming into contact with box top panel 76U when package 378 is dropped.

As described above, cushioning material 374 supports toner cartridge 32 without coming into direct contact with toner supply port 66, thereby fixing the position of toner cartridge 32 inside packing box 76 and maintaining upper space SPU.

According to the above configuration, cushioning material top panel 274U of cushioning material 274 in packing device 277 is omitted from packing device 377. Thus, compared with cushioning material 274 according to the third embodiment, the configuration of cushioning material 374 can be simplified by omitting more members, and therefore costs can be reduced.

Moreover, package 378 eliminates the need for the worker to build cushioning material 374, and can be set in a transportable state just by putting toner cartridge 32 into packing box 76. Thus, the building operation can be omitted.

Besides the above, packing device 377 according to the fourth embodiment can achieve the same advantageous effects as those achieved by packing device 77 according to the first embodiment.

5. Other Embodiments

Note that, in the first embodiment described above, the description is given of the case where toner cartridge 32 is supported by front-side tucking panel 88F and back-side tucking panel 88B.

However, the invention is not limited to such a configuration, and toner cartridge 32 may be supported by only one of front-side tucking panel 88F and back-side tucking panel 88B. The same applies to the second to fourth embodiments.

Also, in the first embodiment described above, the description is given of the case where package 78 is configured such that box bottom panel 76D of packing box 76, cushioning material bottom panel 74D of cushioning material 74 and container side surface 58A of toner cartridge 32 are positioned at the bottom side.

However, the invention is not limited to such a configuration. Package 78 may be configured such that box bottom panel 76D of packing box 76, cushioning material bottom panel 74D of cushioning material 74 and container side surface 58A of toner cartridge 32 are positioned at the top side. The same applies to the second to fourth embodiments.

Furthermore, in the invention, cushioning materials 74 to 374 according to the first to fourth embodiments may be appropriately modified and combined, such as omitting front-side tucking panel 88F and back-side tucking panel 88B from cushioning material 74 and disposing cushioning material 274 between cushioning material front panel 74F and cushioning material back panel 74B, for example.

In the embodiments described above, the description is given of the case where the invention is applied when toner cartridge 32 with convex part 64 having the arc shape when viewed from the side is supported inside packing box 76.

However, the invention is not limited to such a case, but may be applied to toner cartridges having various shapes, such as a square shape when viewed from the side, for example. In essence, any shape may be adopted as long as movement of the toner cartridge toward one of the side surfaces of packing box 76 can be restricted by allowing front-side tucking panel 88F and back-side tucking panel 88B to come into contact with predetermined spots of the toner cartridge.

Moreover, in the above embodiments, the description is given of the case where the invention is applied to protect toner cartridge 32 as the packing target object from impact. However, the invention is not limited to such a case, but may be applied to various objects to be packed, such as electronic devices and electrical devices, which are stored in packing box 76 and in which a protection target part from impact is formed at a predetermined position.

Furthermore, in the above embodiments, the description is given of the case where the invention is applied to protect toner supply port 66 formed in supply port side surface 58D of toner cartridge 32.

However, the invention is not limited to such a case, but may be applied to protect more than one protection target part, when the parts to be protected are formed on one side surface of the packing target object and on the other side surface opposite to the one side surface, for example, by allowing front-side tucking panels and back-side tucking panels to come into contact with each other without having direct contact with the parts to be protected.

Furthermore, in the above embodiments, the description is given of the case where cushioning material 74 is made of cardboard. However, the invention is not limited thereto, and cushioning material 74 may be made of various other materials, such as plastic, for example.

Furthermore, in the above embodiments, the description is given of the case where packing box 76 is made of cardboard. However, the invention is not limited thereto, and packing box 76 may be made of various other materials, such as kraft paper, for example.

Furthermore, in the above embodiments, the description is given of the case where packing box 76 has the rectangular parallelepiped shape. However, the invention is not limited thereto, and packing box 76 may have various other shapes as long as the packing box has a surface facing the protection target part formed in the packing target object.

Furthermore, in the above embodiments, the description is given of the case where packing bodies 77 to 377 as the packing device include packing box 76 as the packing box and cushioning materials 74 to 374 as the cushioning materials.

However, the invention is not limited thereto, and the packing device may include a packing box and a cushioning material having various other configurations.

The invention can be used to store and transport a toner cartridge in a packed state, which is detachably mounted on an image formation apparatus such as a printer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A package comprising:

a packing target object;

a packing box comprising: a first packing box panel and a second packing box panel facing each other; a third packing box panel connecting with the first packing box panel at a first corner which corresponds to one end of the first packing box panel and connecting with the second packing box panel at a second corner which corresponds to one end of the second packing box panel, the first, second and the third packing box panels defining an internal space capable of storing therein the packing target object, wherein the packing target object includes a convex protection target part facing an inner surface of the third packing box panel, a first contact surface closer to the first packing box panel than the protection target part, and a second contact surface closer to the second packing box panel than the protection target part; and a holding material comprising: a first holding material panel provided along the first packing box panel; a second holding material panel provided along the second packing box panel; a first contact material extending linearly from a first folding part of the first holding material panel toward and contacting with the first contact surface of the packing target object; and a second contact material extending linearly from a second folding part of the second holding material panel toward and contacting with the second contact surface of the packing target object, wherein the first folding part is in contact with an inside of the first corner and the second folding part is in contact with an inside of the second corner, such that the holding material, when stored in the internal space together with the packing target object, maintains a space between the packing target object and the inner surface of the third packing box panel.

2. The package according to claim 1, wherein the holding material is configured to restrict movement of the packing target object toward the inner surface of the third packing box panel.

3. The package according to claim 1, wherein a distance of the first and second contact materials from the contact surfaces to the inner surface of the third packing box panel in a direction approximately perpendicular to the inner surface of the third packing box panel is longer than a distance from the contact surfaces to an end of the packing target object in the direction approximately perpendicular to the inner surface of the third packing box panel.

4. The package according to claim 1, wherein the packing target object further includes a first side surface facing the first packing box panel and a second side surface on an opposite side to the first side surface and facing the second packing box panel, the protection target part not being formed on the first side surface or the second side surface.

5. The package according to claim 4, wherein the first and second contact materials are biased toward the packing target object by a resilient force that returns the first and second contact materials to their original shapes from the folded state.

6. The package according to claim 1, wherein the first and second contact surfaces of the packing target object extend in a packing target object width direction in which the protection target part extends, the first and second contact materials come into contact with the first and second contact surfaces, respectively, along the packing target object width direction, and a length of the first and second contact materials in the packing target object width direction is ⅓ to ⅔ of a length of the packing target object in the packing target object width direction.

7. The package according to claim 4, wherein the protection target part is formed in an arc shape, and the first contact surface is provided at a position farther from the first corner than a portion of the arc shape closest to the first holding material panel.

8. The package according to claim 4, wherein the protection target part is formed in an arc shape, and the first contact material comes into contact with the packing target object at a position farther from the first corner than a portion of the arc shape closest to the first holding material panel in the arc-shaped protection target part.

9. The package according to claim 1, wherein the packing target object is a developer container having developer therein.

10. The package according to claim 1, wherein the protection target part includes an opening.

11. The package according to claim 1, wherein the packing target object is a developer container having developer therein and includes an opening as the protection target part through which the developer is to be supplied.

12. The package according to claim 1, wherein the first contact material is provided at an acute angle of not more than 20 degrees relative to the first packing box panel, and the second contact material is provided at an acute angle of not more than 20 degrees relative to the second packing box panel.

13. The package according to claim 1, wherein the first contact material is fold at the first folding part from the first holding material panel at an acute angle of not more than 20 degrees relative to the first packing box panel, and the second contact material is folded at the second folding part from the second holding material at an acute angle of not more than 20 degrees relative to the second packing box panel.

14. The package according to claim 7, wherein the second contact surface is provided at a position farther from the second corner than a portion of the arc shape closest to the second holding material panel.

15. The package according to claim 8, wherein the second contact material comes into contact with the packing target object at a position farther from the second corner than a portion of the arc shape closest to the second holding material panel in the arc-shaped protection target part.

16. The package according to claim 1, wherein the first contact material is not parallel to the first contact surface, and the second contact material is not parallel to the second contact surface.

* * * * *